US009236036B2

(12) United States Patent
Finkle

(10) Patent No.: US 9,236,036 B2
(45) Date of Patent: Jan. 12, 2016

(54) STRINGED INSTRUMENT SYSTEM

(71) Applicant: Scott Finkle, Randolph, MA (US)

(72) Inventor: Scott Finkle, Randolph, MA (US)

( * ) Notice: Subject to any disclaimer, the term of this patent is extended or adjusted under 35 U.S.C. 154(b) by 0 days.

(21) Appl. No.: 14/041,664

(22) Filed: Sep. 30, 2013

(65) Prior Publication Data

US 2014/0123830 A1 May 8, 2014

Related U.S. Application Data

(63) Continuation of application No. 13/423,928, filed on Mar. 19, 2012, now Pat. No. 8,546,670.

(51) Int. Cl.

| | |
|---|---|
| ***G10D 3/14*** | (2006.01) |
| ***G10D 1/08*** | (2006.01) |
| ***G10D 3/04*** | (2006.01) |
| ***G10D 3/12*** | (2006.01) |

(52) U.S. Cl.

CPC ..... *G10D 3/146* (2013.01); *G10D 1/08* (2013.01); *G10D 3/04* (2013.01); *G10D 3/12* (2013.01)

(58) Field of Classification Search

IPC ..... G10D 1/08,3/04, 3/12, 3/146

See application file for complete search history.

(56) References Cited

U.S. PATENT DOCUMENTS

| | | | | | |
|---|---|---|---|---|---|
| 4,555,970 | A * | 12/1985 | Rose | G10D 3/146 | 84/312 P |
| 4,656,916 | A * | 4/1987 | Gressett, Jr. | G10D 3/146 | 84/313 |
| 4,928,564 | A * | 5/1990 | Borisoff | G10D 3/146 | 84/313 |
| 4,984,493 | A * | 1/1991 | Schaller | G10D 3/146 | 84/313 |
| 5,198,601 | A * | 3/1993 | McCabe | G10D 3/146 | 84/298 |
| 5,373,769 | A * | 12/1994 | Sherman | G10D 3/146 | 84/313 |
| 5,539,144 | A * | 7/1996 | Sherman | G10D 3/146 | 84/267 |
| 5,551,329 | A * | 9/1996 | Iovane | G10D 3/146 | 84/313 |

(Continued)

*Primary Examiner* — David Warren

(74) *Attorney, Agent, or Firm* — Bay State IP, LLC

(57) ABSTRACT

A tremolo device for static retention of a plurality of musical instrument strings in a stringed instrument. The tremolo device has a body with an upper surface, a neck portion, and a plurality of strings anchored at a first end of the neck and extending over at least a portion and secured to the tremolo device at the other end of the neck portion and the body and possesses an inertia block mechanism with substantially solid construction disposed to receive and securely retain a plurality of raw instrument strings without removal of a ball end from each string. The inertia block has an upper portion, a lower portion, and a plurality of internal, longitudinally displaced, cylindrically shaped, string retaining chambers designed to pass through an entirety of the block mechanism. The string retaining chambers have an upper and lower portion corresponding with the upper and lower portions of the block.

8 Claims, 41 Drawing Sheets

(56) References Cited

U.S. PATENT DOCUMENTS 5,959,224 A * 9/1999 McCune ..... G10D 3/146 84/313
6,552,252 B2 * 4/2003 Hirayama ..... G10D 3/146 84/313
6,989,483 B2 * 1/2006 Ramsay ..... G10D 3/146 84/313
7,053,287 B2 * 5/2006 Dam ..... G10D 3/146 84/313
8,940,986 B1 * 1/2015 Edwards ..... G10D 3/14 84/267
2002/0043147 A1 * 4/2002 Herbold ..... G10D 3/146 84/313
2004/0255752 A1 * 12/2004 Geier ..... G10D 3/146 84/313
2006/0272471 A1 * 12/2006 Lavineway ..... G10D 3/146 84/313
2006/0288840 A1 * 12/2006 Geier ..... G10D 3/146 84/313
2007/0169609 A1 * 7/2007 Gawenda ..... G10D 3/146 84/322
2008/0148919 A1 * 6/2008 LaMarra ..... G10D 3/04 84/307
2008/0229900 A1 * 9/2008 Steinberger ..... G10D 3/146 84/313
2009/0314152 A1 * 12/2009 Shamblin ..... G10D 3/146 84/313
2010/0175534 A1 * 7/2010 McCabe ..... G10D 3/14 84/313
2010/0257991 A1 * 10/2010 Williams ..... G10D 3/146 84/313
2011/0011238 A1 * 1/2011 Toone ..... G10D 3/14 84/297 S
2011/0259172 A1 * 10/2011 Hannapel ..... G10D 3/146 84/313
2012/0132055 A1 * 5/2012 Brinkley, Jr. ..... G10D 3/146 84/313
2012/0234155 A1 * 9/2012 Finkle ..... G10D 3/146 84/313
2012/0318117 A1 * 12/2012 Deck ..... G10D 3/146 84/313
2013/0019736 A1 * 1/2013 Finkle ..... G10D 3/00 84/313
2013/0239771 A1 * 9/2013 Kernick ..... G10D 3/146 84/313
2013/0291705 A1 * 11/2013 Rose ..... G10D 3/146 84/297 R
2014/0020545 A1 * 1/2014 van Ekstrom ..... G10D 3/146 84/307
2014/0165817 A1 * 6/2014 Cadwell ..... G10D 3/146 84/313
2014/0174276 A1 * 6/2014 Deck ..... G10D 3/146 84/313
2014/0202308 A1 * 7/2014 Maslarov ..... G10D 3/146 84/313
2015/0047493 A1 * 2/2015 Leadbetter ..... G10H 1/44 84/454
2015/0075351 A1 * 3/2015 Deck ..... G10D 3/146 84/313

* cited by examiner

STRINGED INSTRUMENT SYSTEM

CROSS-REFERENCE TO RELATED APPLICATION

This application is a Continuation, and claims the benefit of and takes priority from U.S. application Ser. No. 13/423,928 filed on Mar. 19, 2012, which in turn claims the benefit of and takes priority from U.S. App. No. 61/454,073 filed on Mar. 18, 2011, the contents of which are hereby incorporated by reference.

FIELD OF THE INVENTION

The present invention relates generally to string instruments, mainly guitars, including improvements to guitar parts and particularly to tremolos for retaining strings.

BACKGROUND OF THE INVENTION

Floyd Rose® retainer systems and similar units regularly require the cutting of the ball end of each of the individual strings and manually clamping the strings to the saddle in order to tune the instrument. In the original Fender® "vintage tremolo" designs and other similar designs, the strings do not enter through the inertia block. These designs also comprise a double locking system without fine tuning mechanisms. In other contemporaneous designs, the ball ends are free to move within the tremolo assembly.

The Floyd Rose® II designs are single locking where the ball end of the string is strung through the bridge plate but is not locked in place, allowing the ball end to move freely within the inertia block or the bridge plate while the tremolo arm was depressed.

These designs were later redesign to include a double locking system. Examples of double locking systems include the Ibanez® Edge, LoPro Edge, EdgePro, EdgePro-II, Edge-III, and EdgeZero. The Ibanez® Zero Resistance is a version of the Ibanez® Edge utilizing a ball-bearing mechanism, instead of a knife-edge, as the fulcrum point and comprises a stop-bar to create consistency in tuning. Other such systems include the Floyd Rose® 7-String, Floyd Rose® Pro, and the Floyd Rose® Speedloader Tremolo.

A variety of tremolo models, such as the Floyd Rose® Speedloader and Steinberger®, required string with two or double ball ends, specifically made for the systems. These strings are manufactured precisely for a given length and use mounted fine tuners to adjust string pitches and tuning.

The Yamaha® Finger Clamp, a variation of the Floyd Rose® system, comprises built-in levers for tuning the instrument. The Fender® Deluxe Locking Tremolo, a double locking system, utilizes locking tuners, a modified Fender® 2-point synchronized tremolo with locking bridge saddles and a special low-friction LSR® Roller Nut, allowing the strings to slide during tremolo use. In this system the second locking point is at the tuning machines instead of the nut.

An apparatus exists that clamps onto a Floyd Rose® to accurately set the intonation of an instrument, alleviating the need to manually adjusting the strings.

The Steinberger® Transposing Tremolo System affords use of the tremolo while maintaining consistent tuning throughout the range of the tremolo. In addition to tuning stability, the system affords the user with instant alternate tunings by manually adjusting the mechanism on the bridge.

SUMMARY OF THE INVENTION

It is an object of the instant system is to lock the strings of an instrument in place in order that the strings may not move with within the block of the tremolo system while still providing a device that is adaptable to various bridges on the market without permanently modifying the instrument.

It is a further object of the invention to eliminate excess string friction and binding within the inertia block while the tremolo is in use. The invention may comprise, in one embodiment, a tremolo system which allows for the attachment of strings in a musical instrument, exclusive of any alteration or diminution to the raw strings and without altering the design of the musical instrument. The present invention vitiates any ill effect on the oscillation capacity of the stock of strings without compromising the integrity of the string or the cores of the strings, regardless if the strings exhibit a wound or unwound design.

DETAILED DESCRIPTION OF THE DRAWINGS

Figure 1:
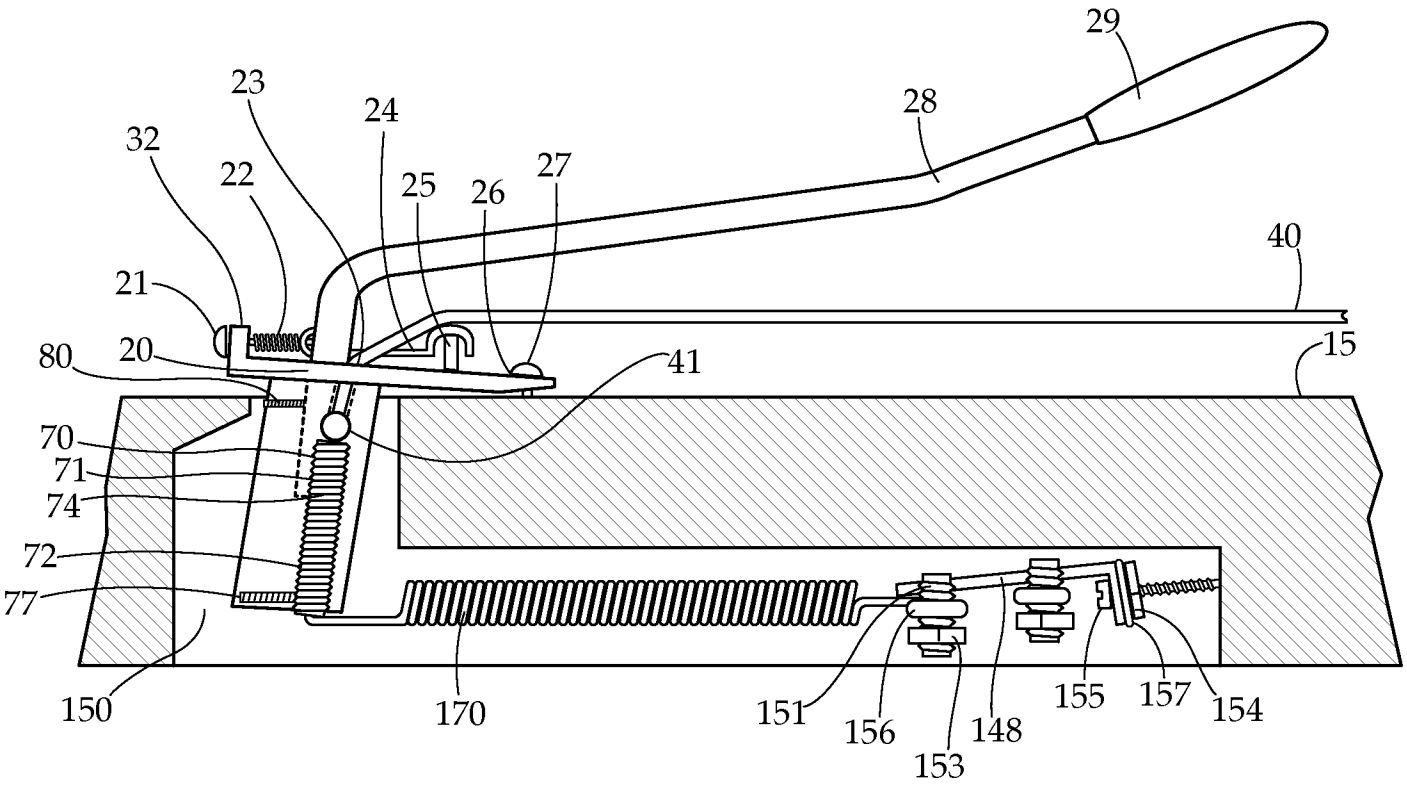
FIG. 1 is a side profile of tremolo system
Figure 2:
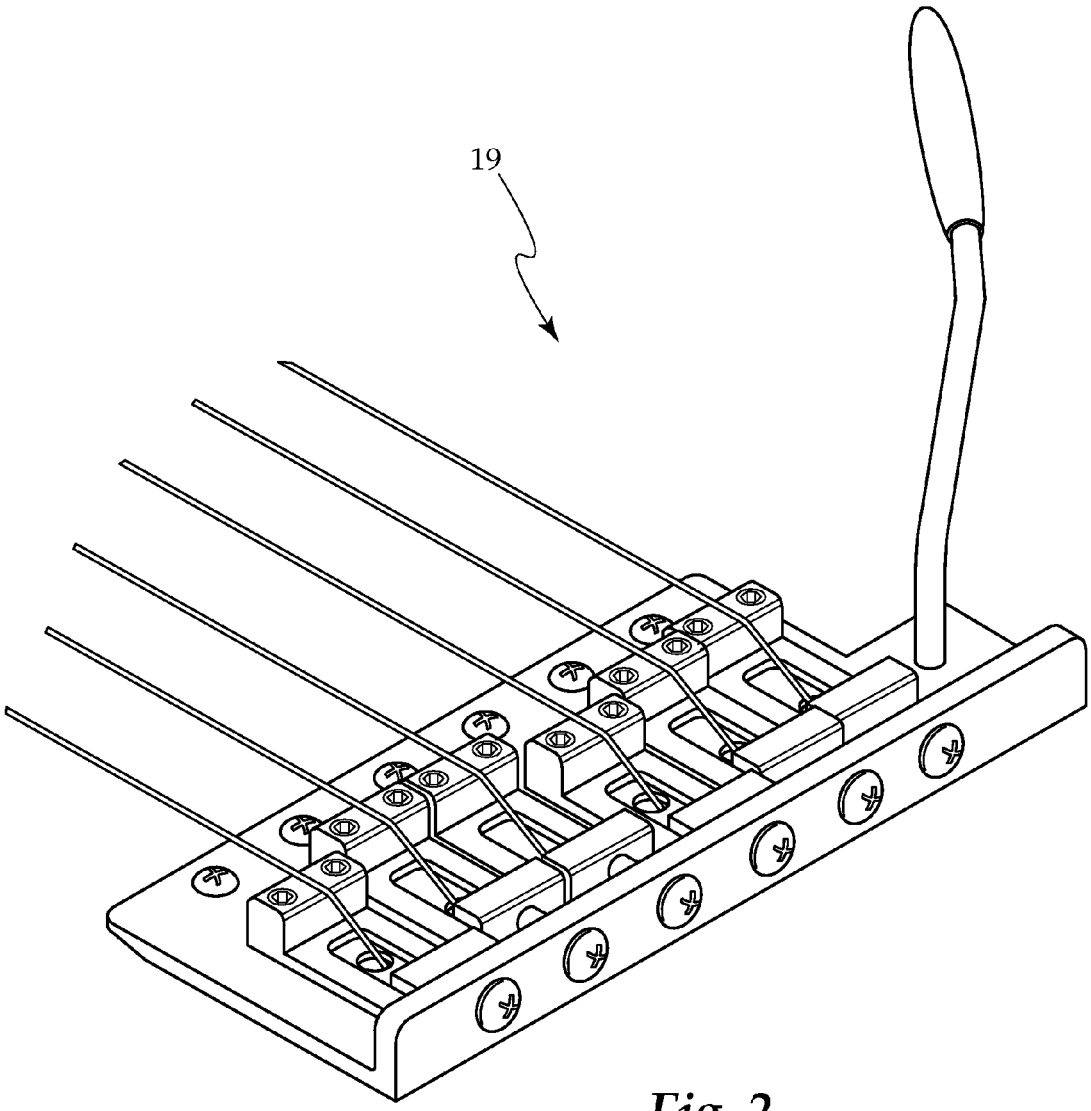
FIG. 2 is a top view of a "Vintage Style" tremolo assembly with tremolo bar and strings
Figure 3:
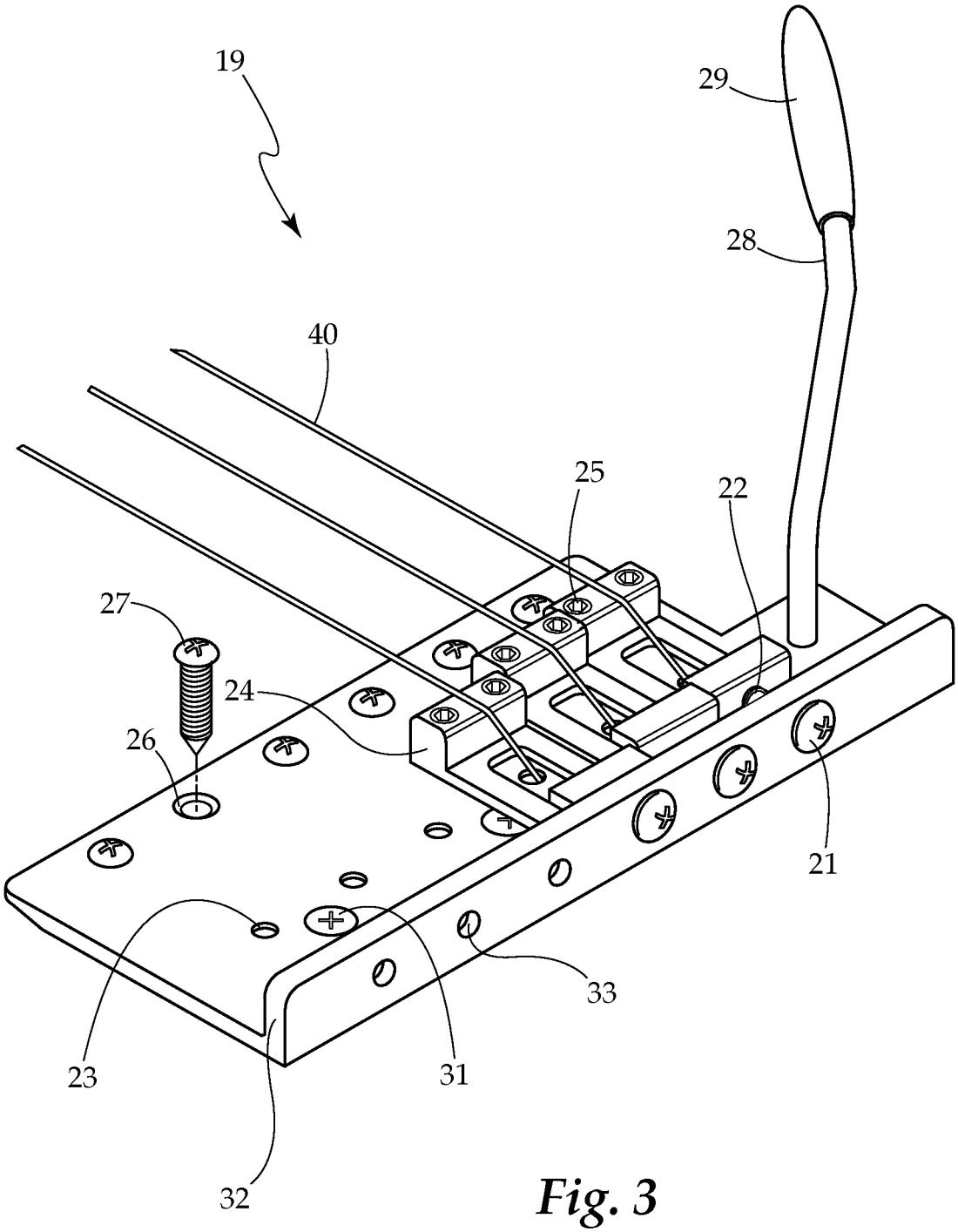
FIG. 3 is a top view of a "Vintage Style" tremolo assembly with tremolo bar and strings
Figure 4:
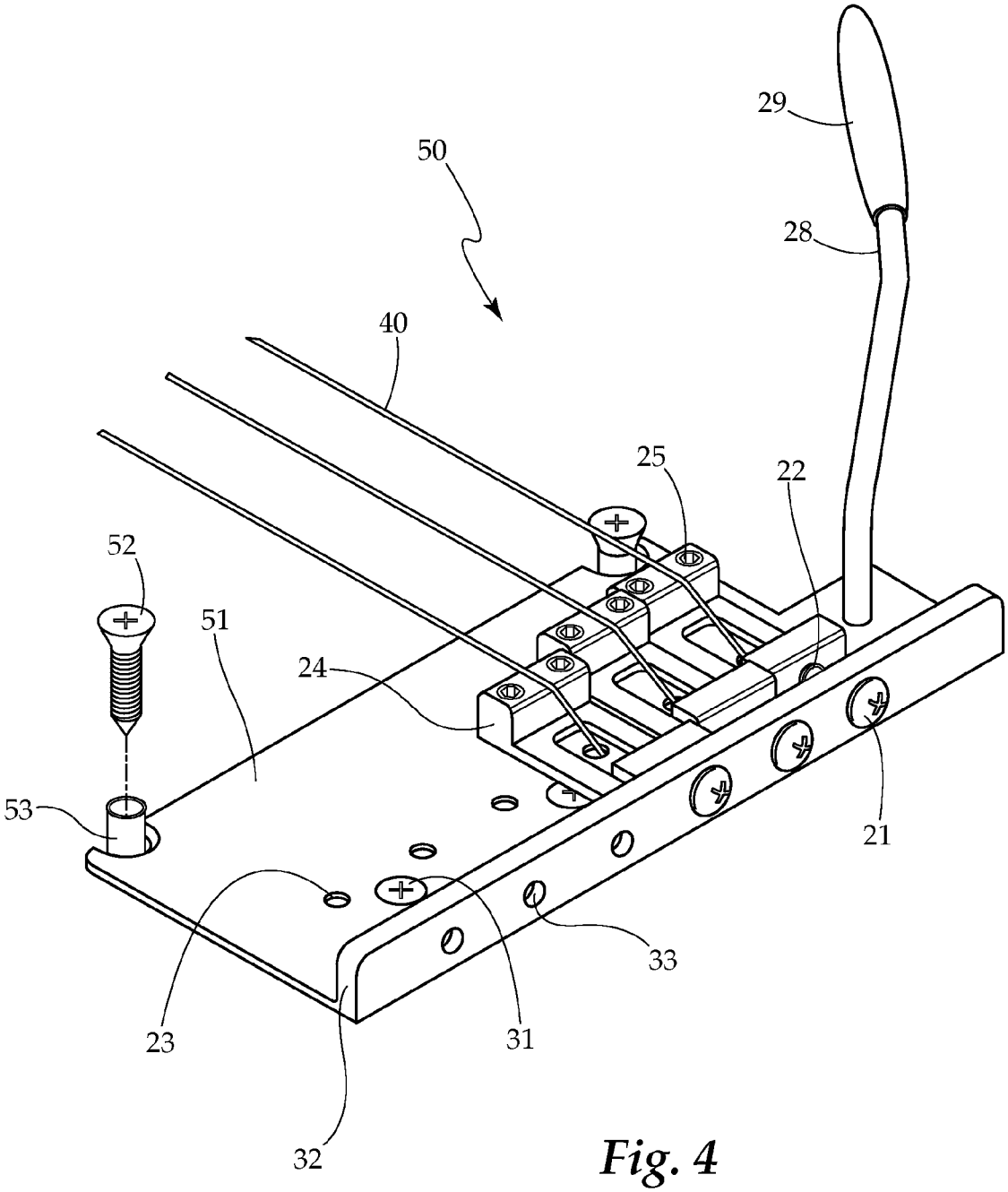
FIG. 4 is a top view of a "Vintage Style" tremolo assembly showing oval/beveled and chamfered string exit holes
Figure 5:
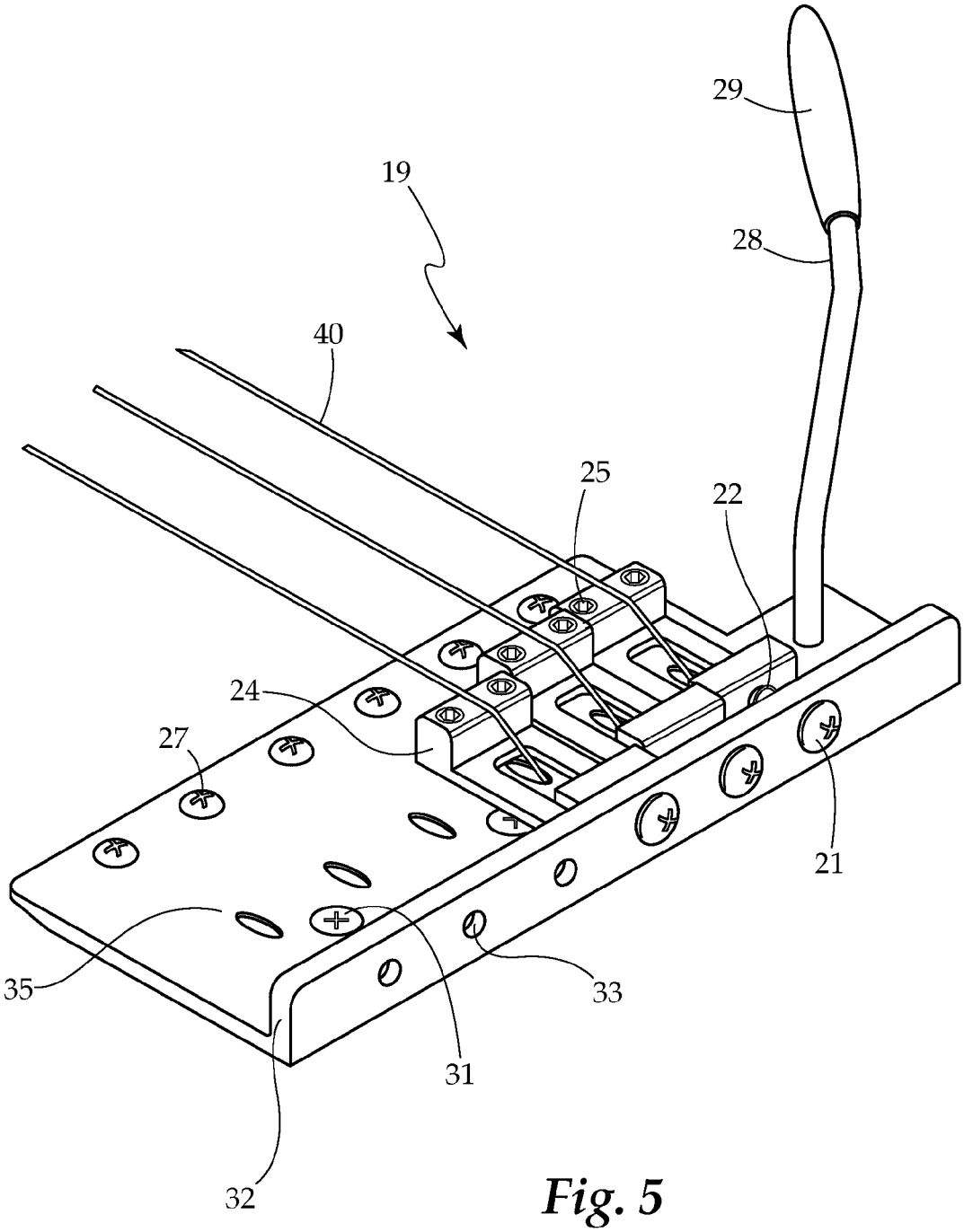
FIG. 5 is a side view of safety claw assembly in tremolo cavity
Figure 6:
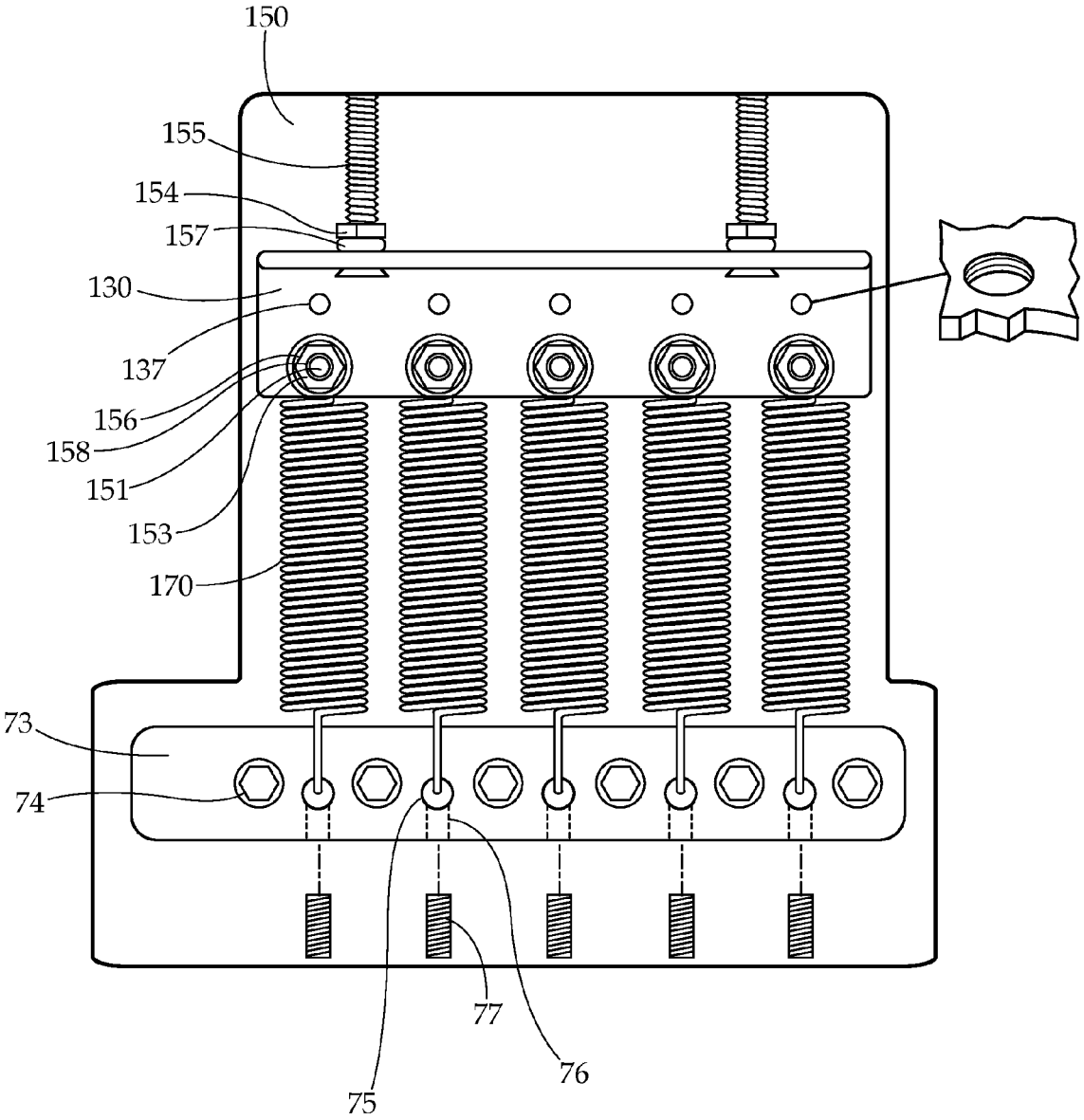
FIG. 6 is a plan view of the screw and block chambers
Figure 7:
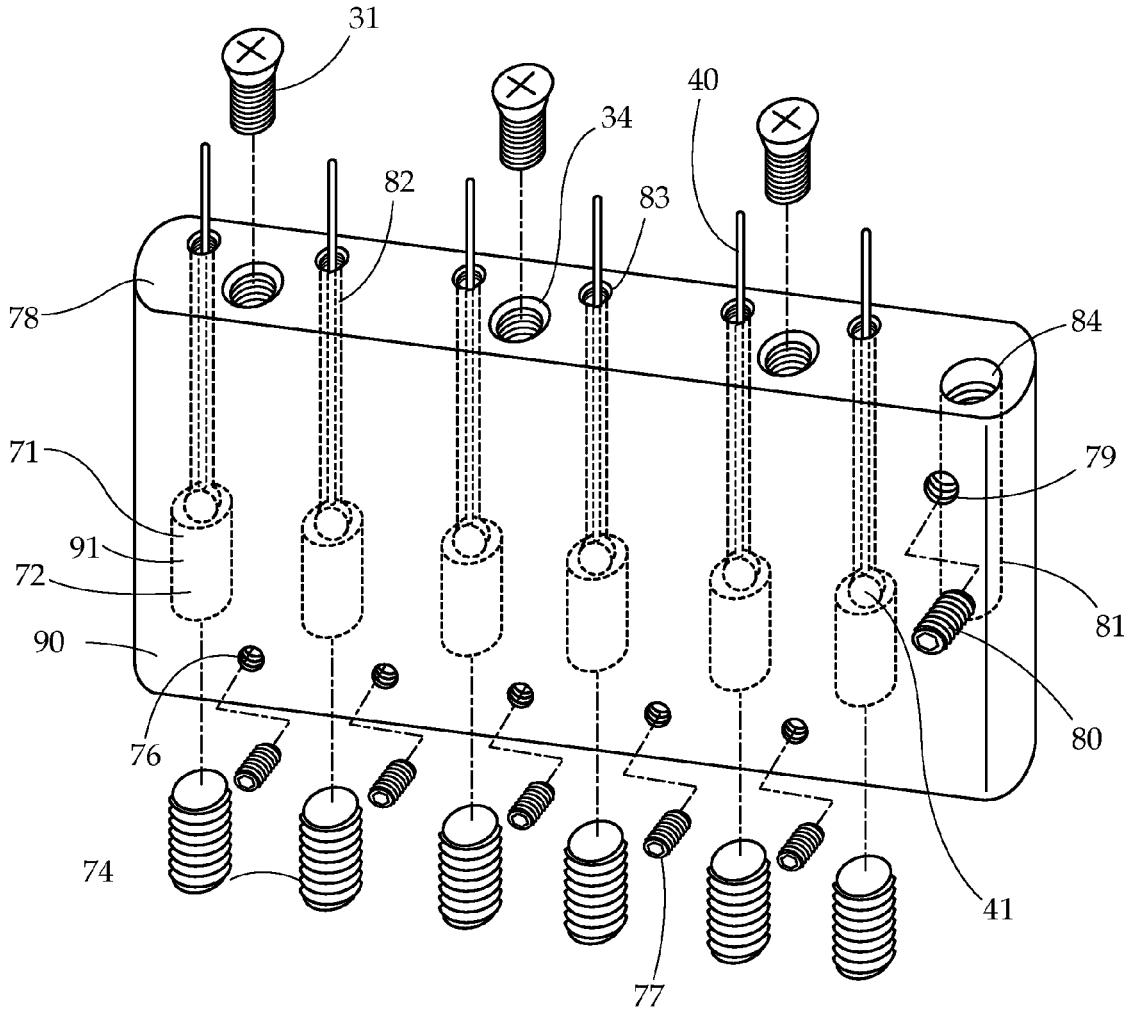
FIG. 7 is a top view of the chambered inertia safety block
Figure 8:
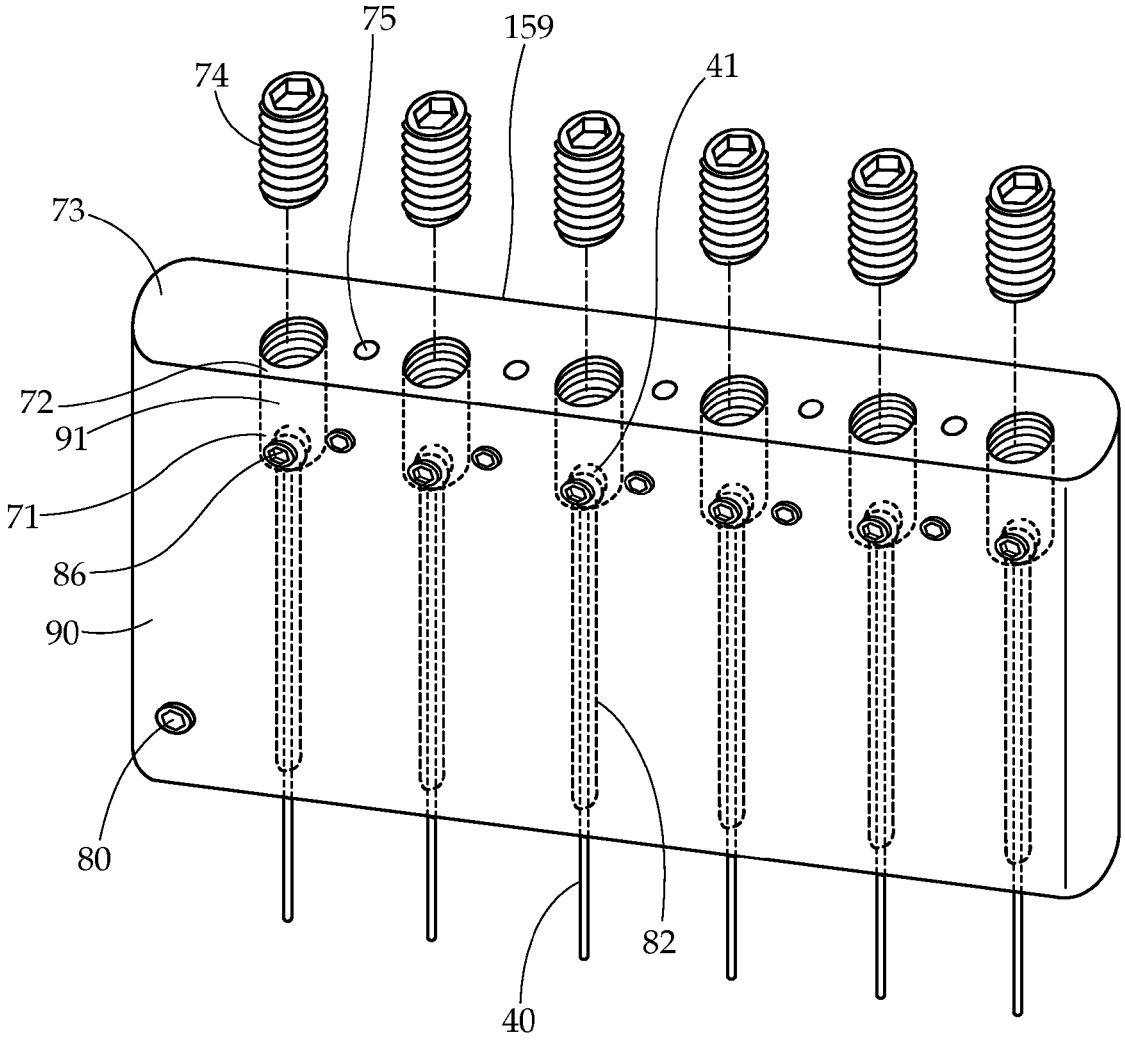
FIG. 8 is a bottom view of the chambered inertia safety block
Figure 9:
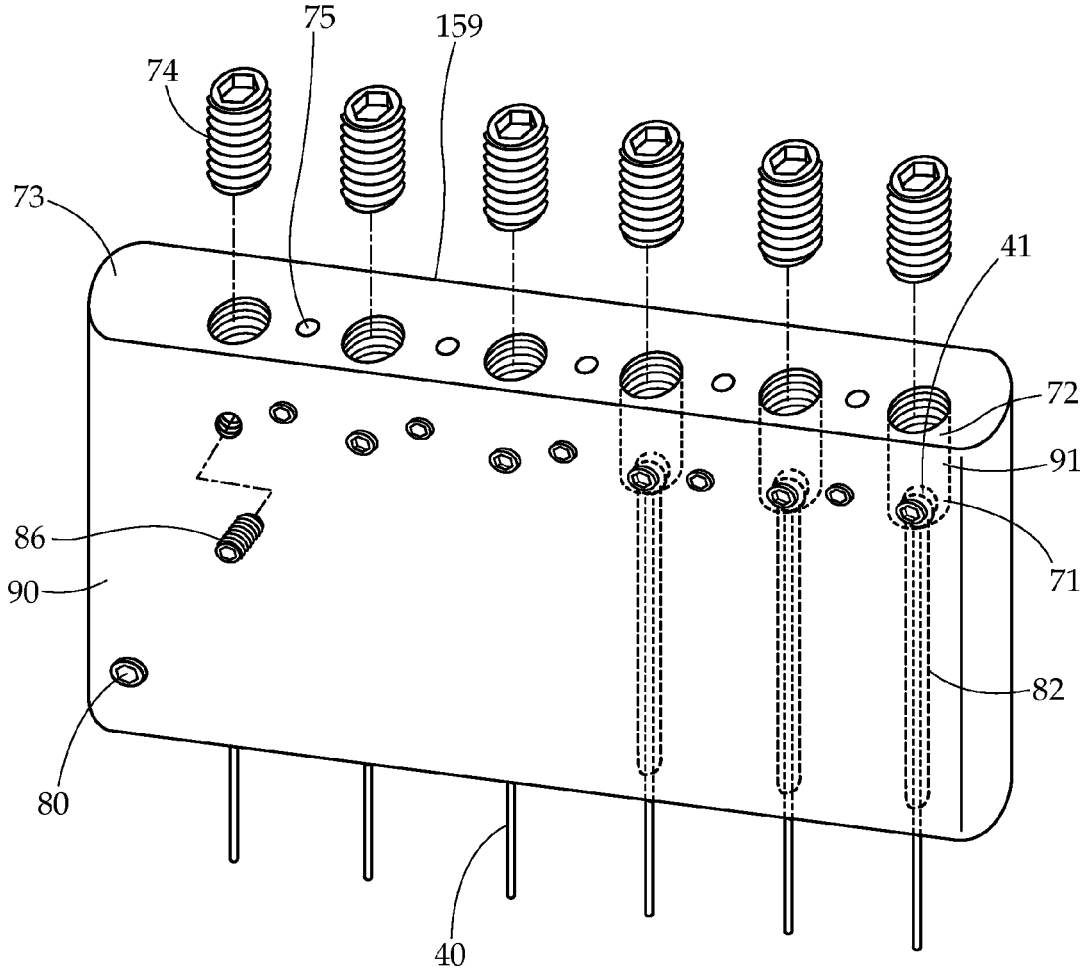
FIG. 9 is a bottom view of the tremolo system showing vibration absorbing material on the inertia block.
Figure 10:
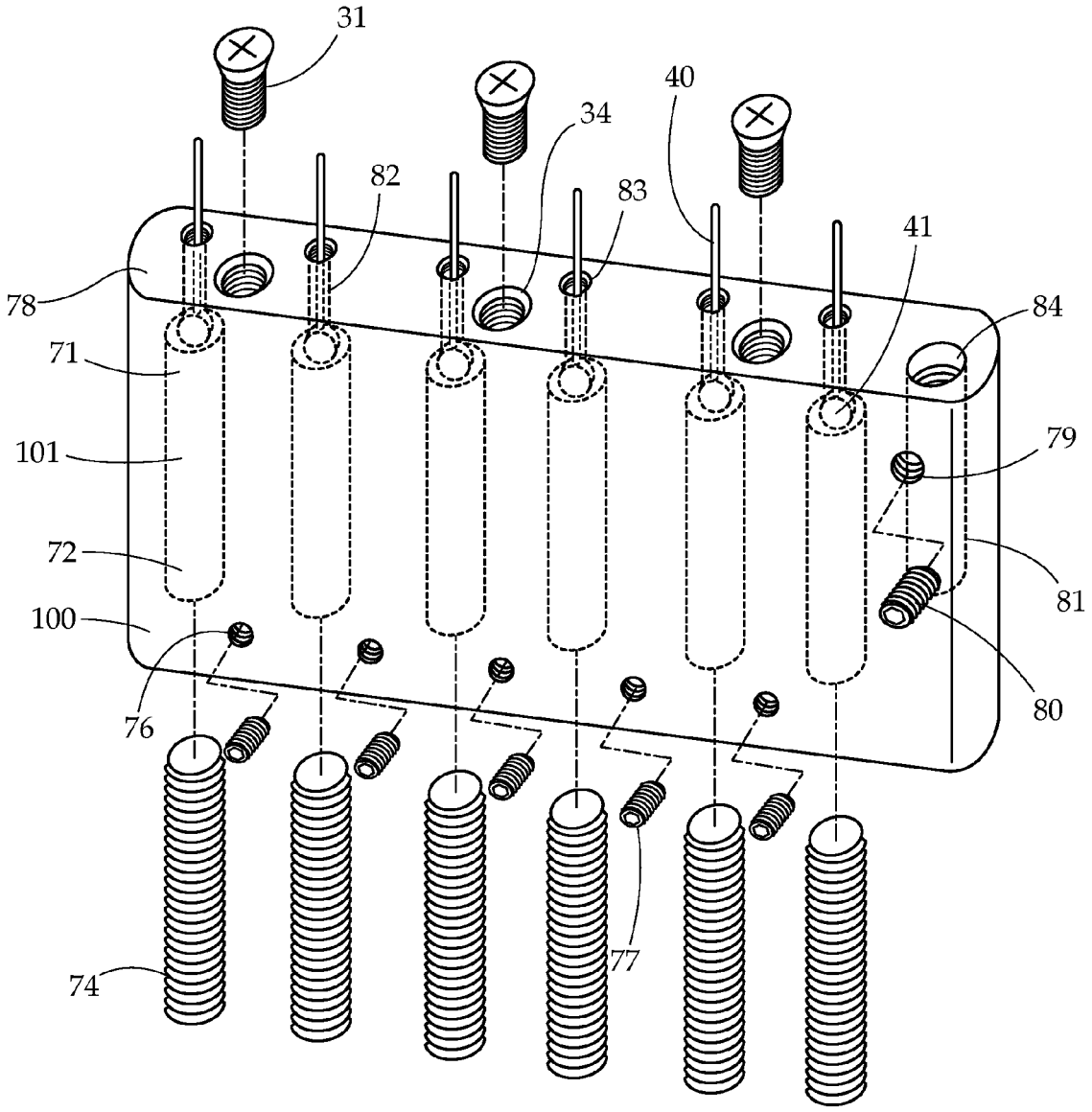
FIG. 10 is a top view of the fixed, modern style, non-adjustable, threaded medium chambered inertia safety block.
Figure 11:
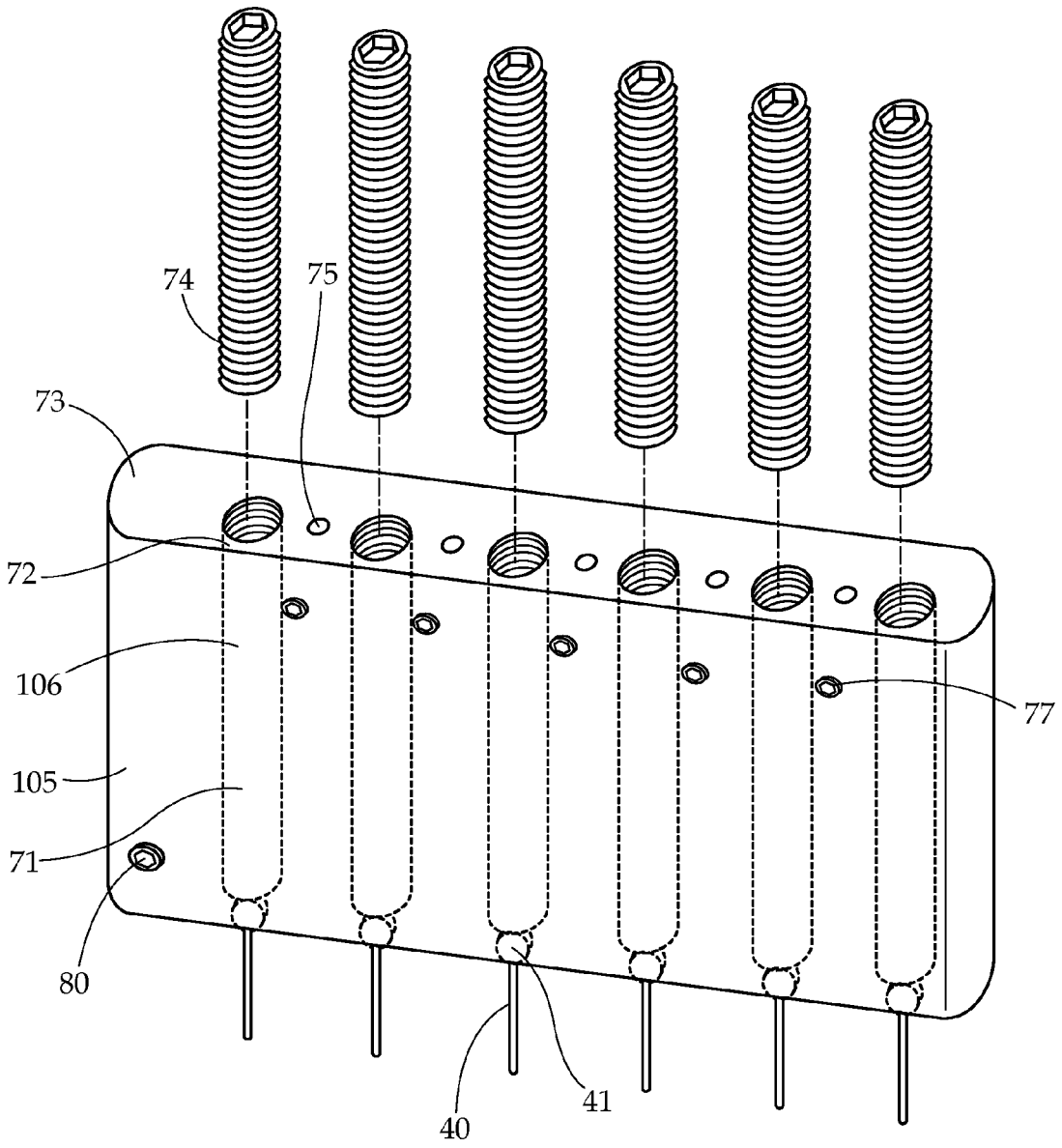
FIG. 11 is a bottom view of the non-adjustable chambered inertia safety block showing bottom or side locking strings.
Figure 12:
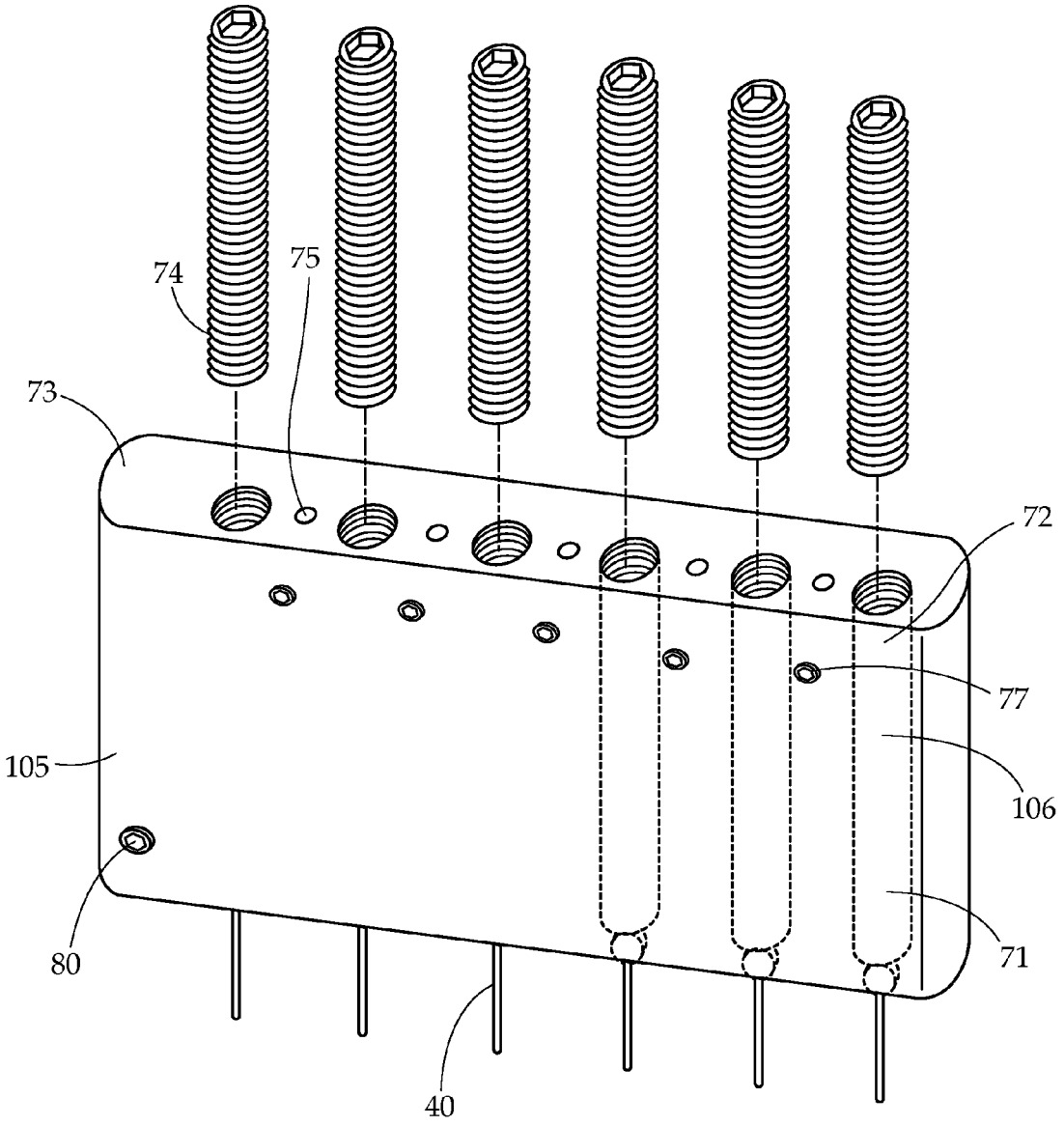
FIG. 12 is a bottom view of the non-adjustable chambered inertia safety block showing bottom or side locking strings.
Figure 13:
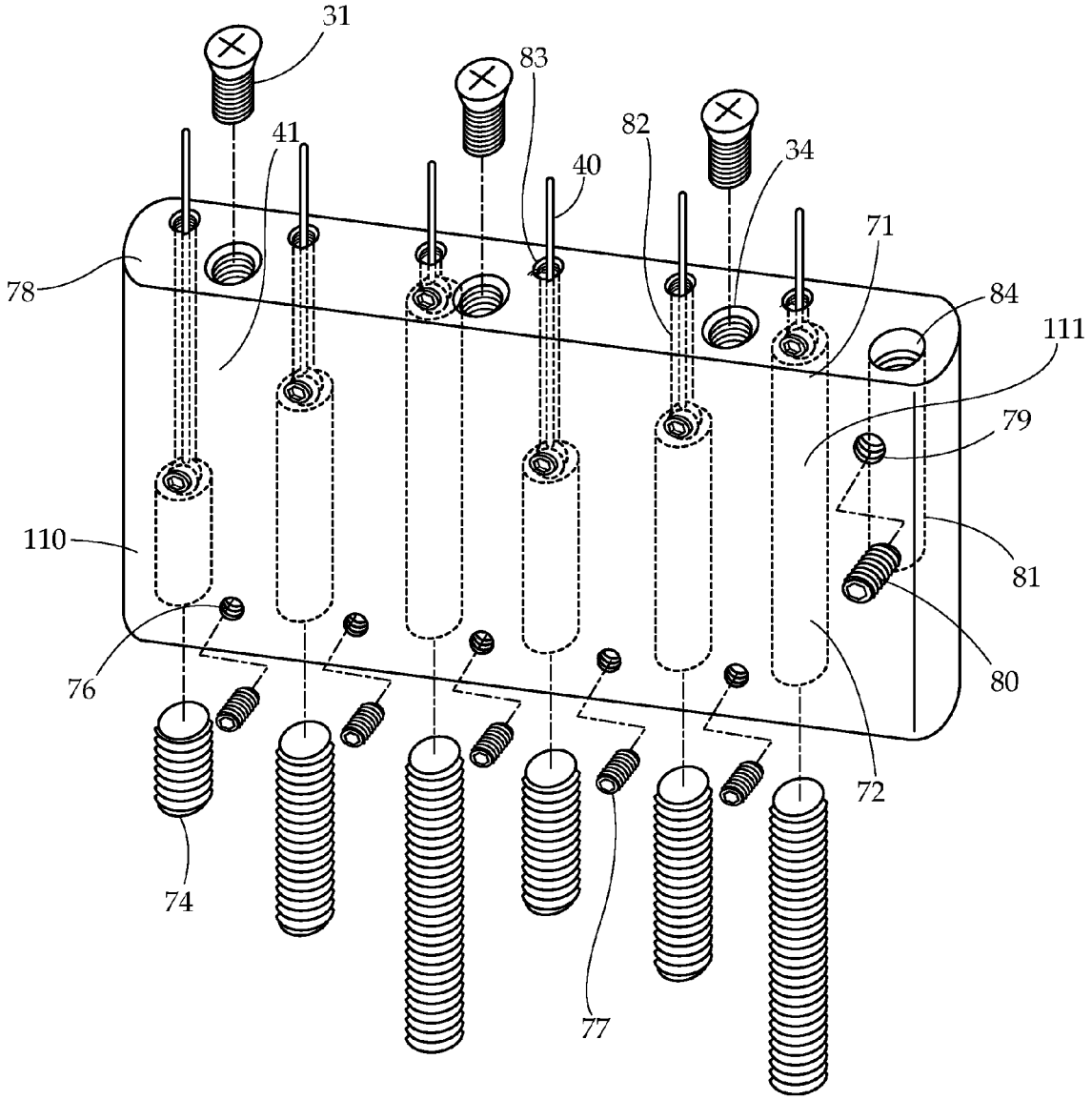
FIG. 13 is a top view of the permanent, non-adjustable chambered inertia safety block.
Figure 14:
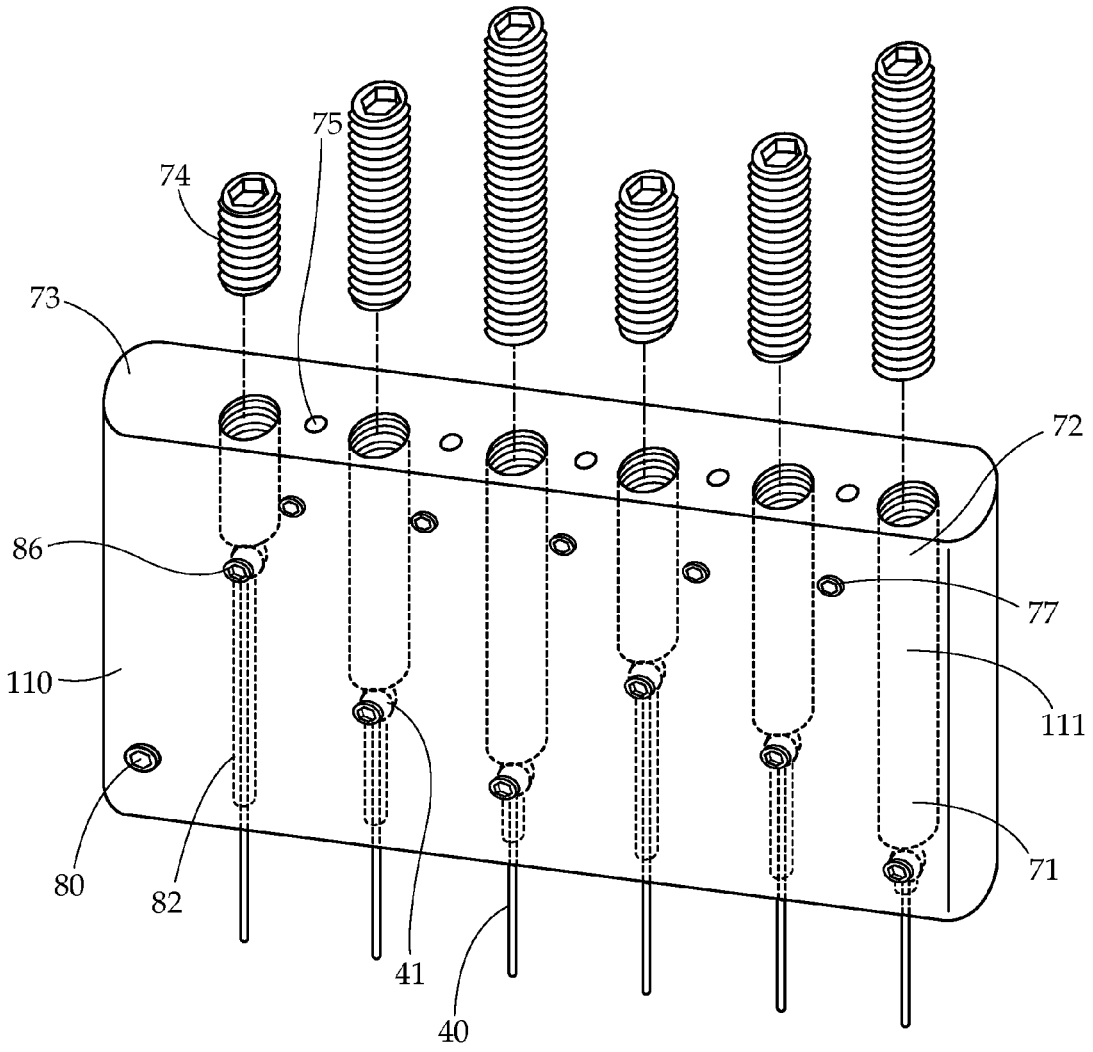
FIG. 14 is a bottom view of chambered inertia safety block showing permanent, physically locking string from top or side.
Figure 15:
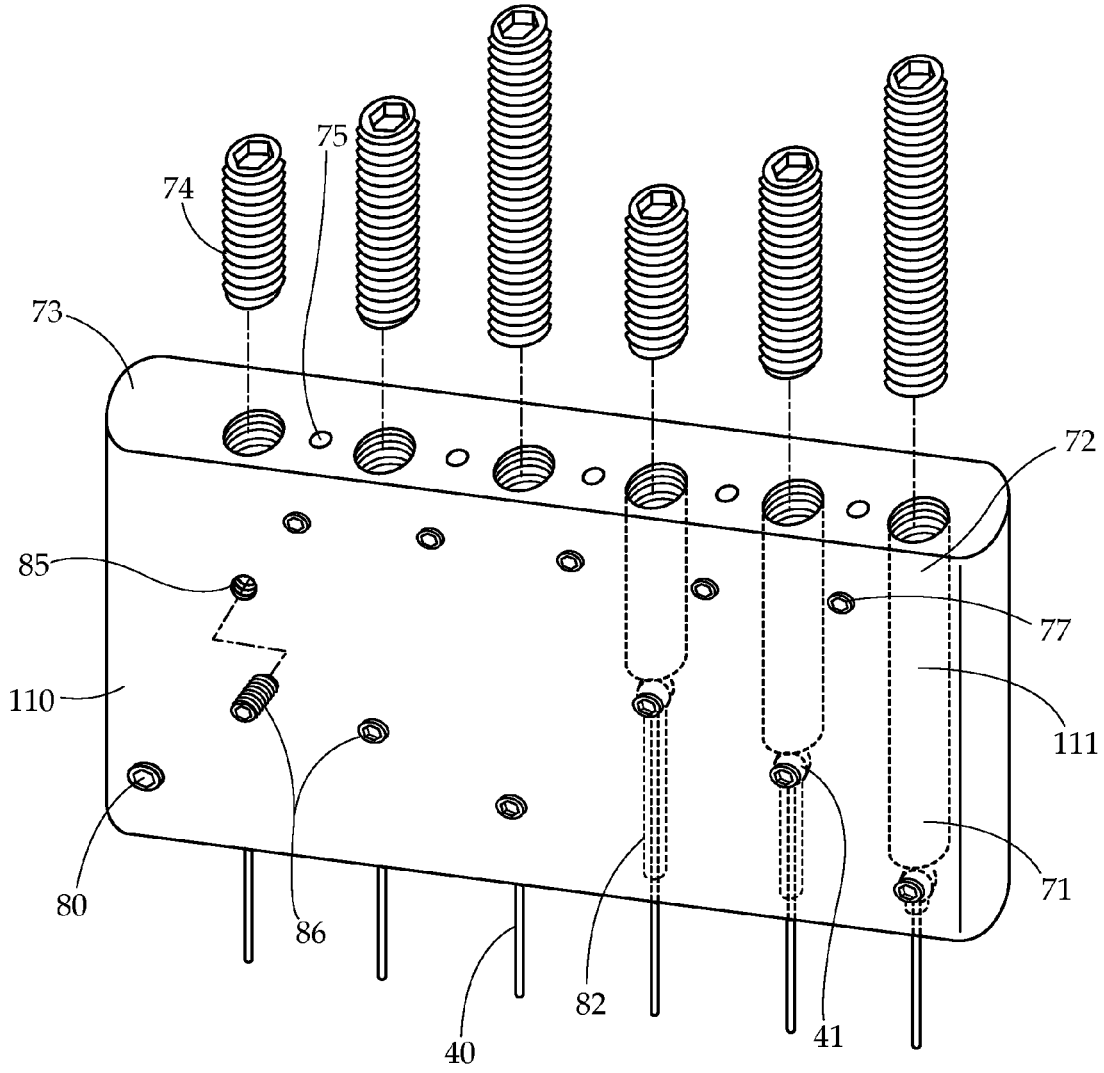
FIG. 15 is a bottom view of chambered inertia safety block showing permanent, physically locking string from bottom or side.
Figure 16:
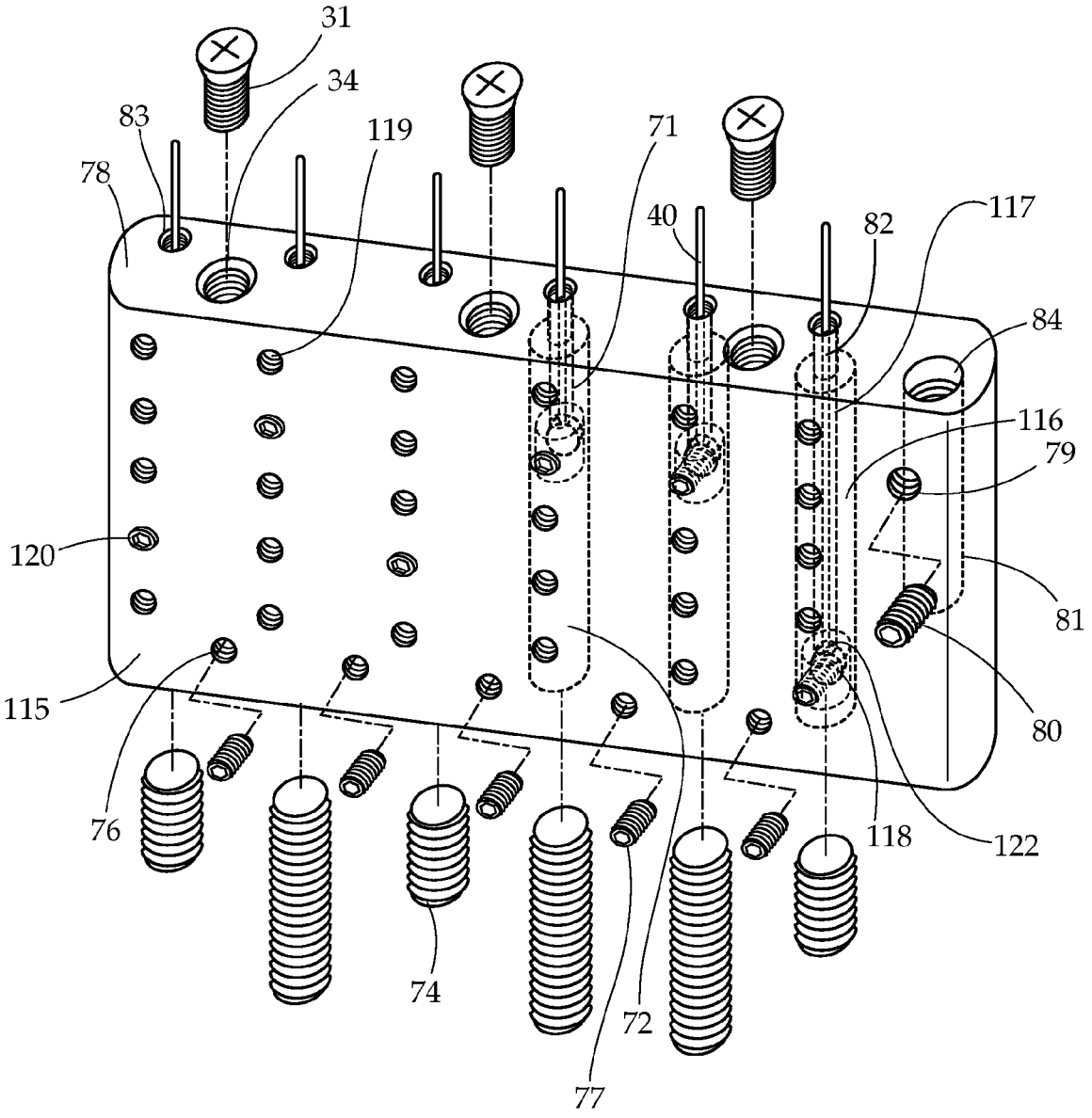
FIG. 16 is a top view of the chambered inertia safety block showing fixed, staggered string chambers.
Figure 17:
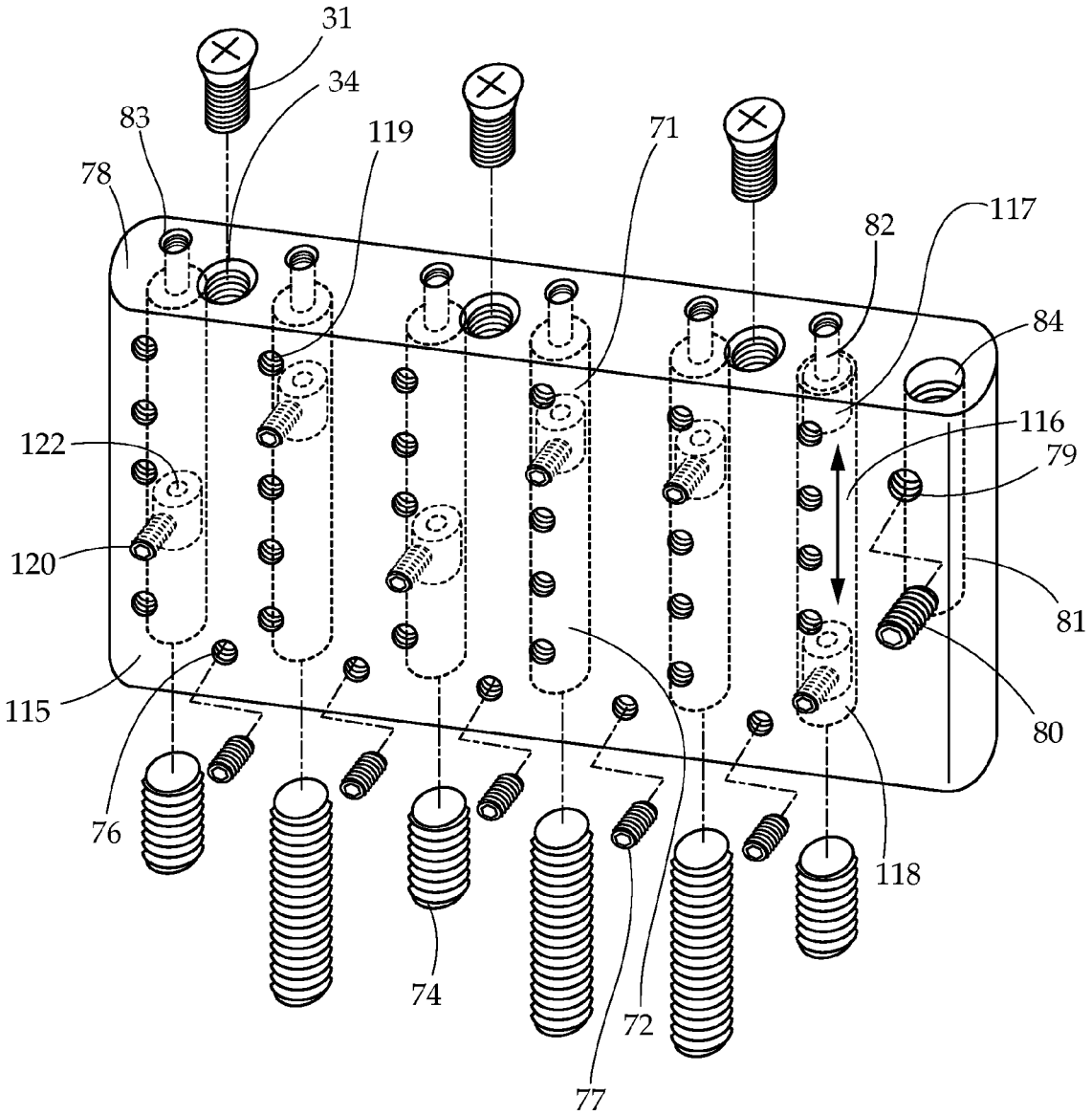
FIG. 17 is a bottom view of chambered inertia safety block showing fixed, staggered string chambers.
Figure 18:
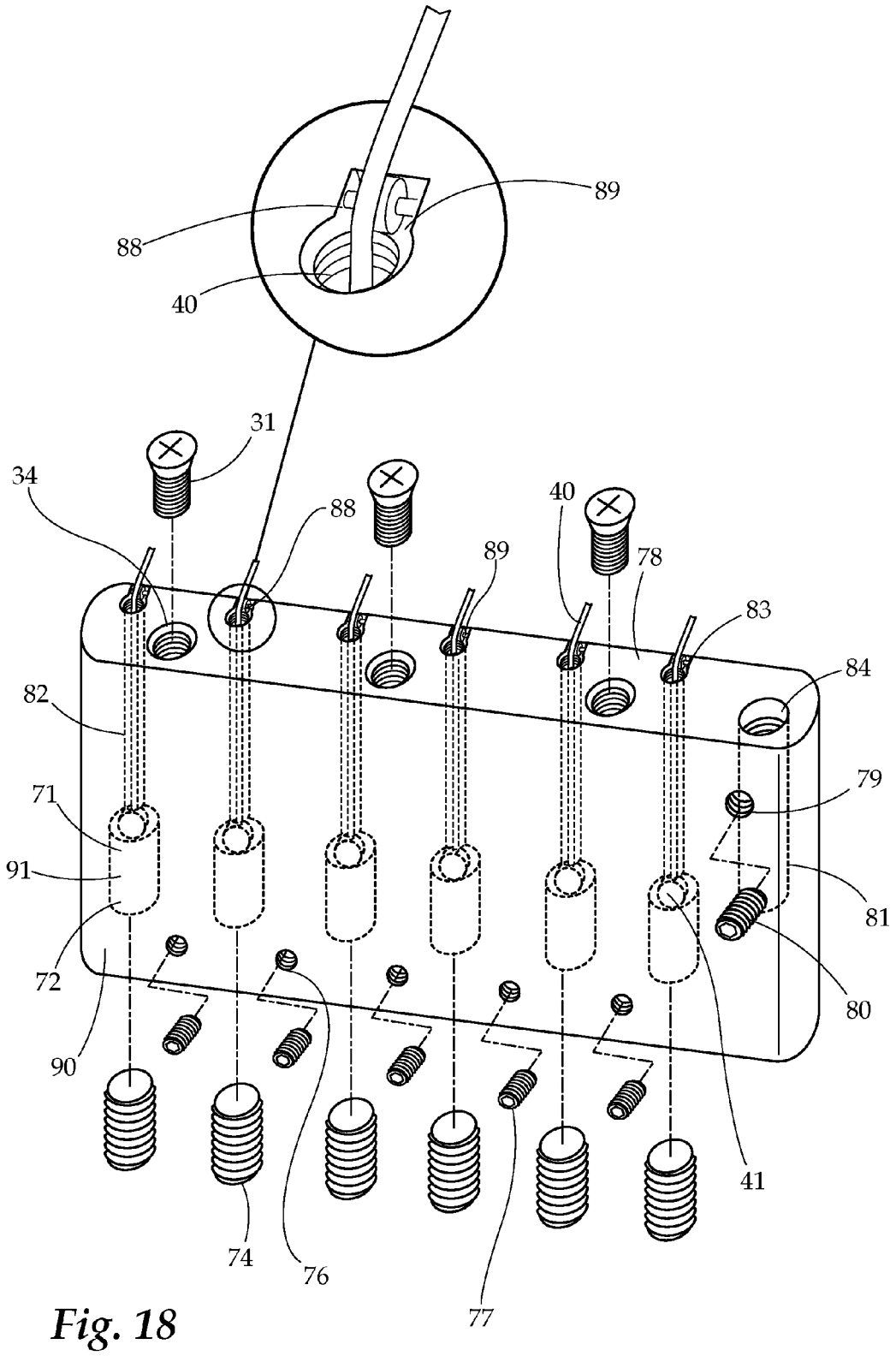
FIG. 18 is a bottom view of chambered inertia safety block showing custom length chambers.
Figure 19:
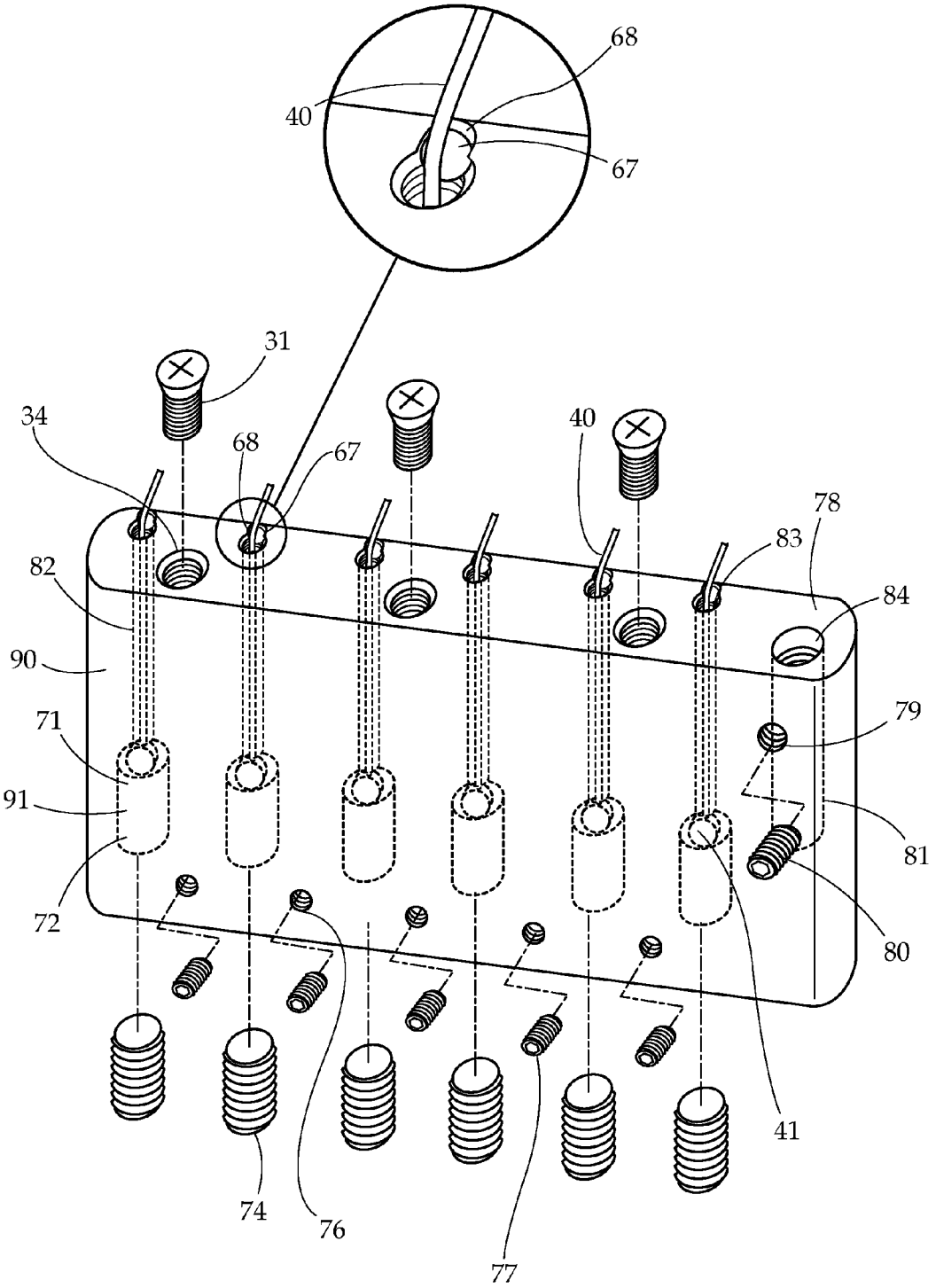
FIG. 19 is a top view of a fully adjustable chambered inertia safety block.
Figure 20A:
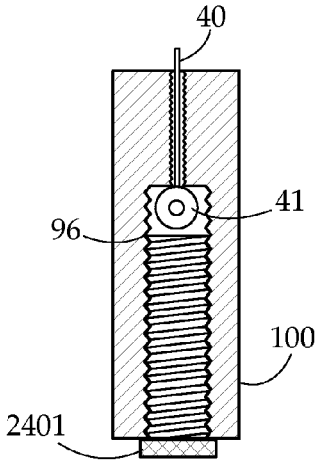
FIG. 20A is a top view of a chambered inertia safety block showing recessed rollers in inertia block string chamber cavity with a medium length fender style-side view.
Figure 20B:
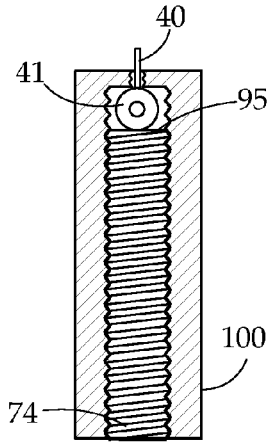
FIG. 20B is a top view of a chambered inertia safety block showing recessed rollers in inertia block string chamber cavity with a full length Paul Reed Smith style-side view.
Figure 20C:
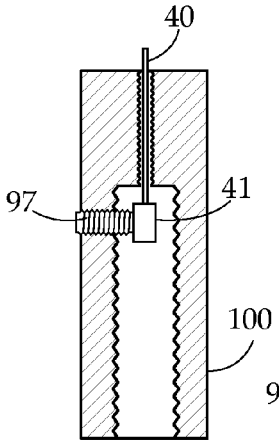
FIG. 20C is a side view of a chambered inertia safety block showing recessed rollers in inertia block string chamber cavity.
Figure 20D:
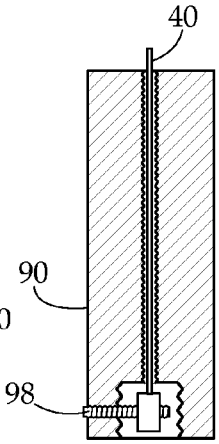
FIG. 20D is a side view of an alternate embodiment chambered inertia safety block showing recessed rollers in inertia block string chamber cavity.
Figure 21A:
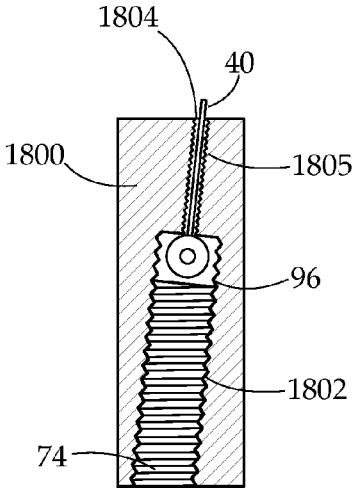
FIG. 21A is a top view of a chambered inertia safety block showing ball bearings with a medium length fender style-side view.
Figure 21B:
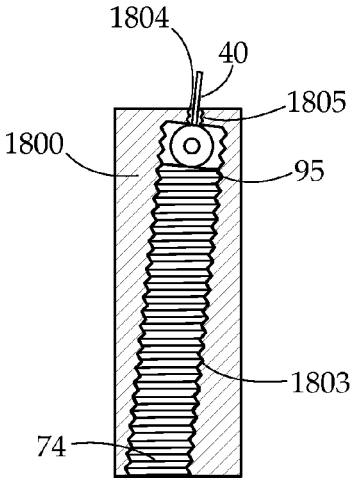
FIG. 21B is a top view of a chambered inertia safety block showing ball bearings with a full length Paul Reed Smith style-side view.
Figure 22:
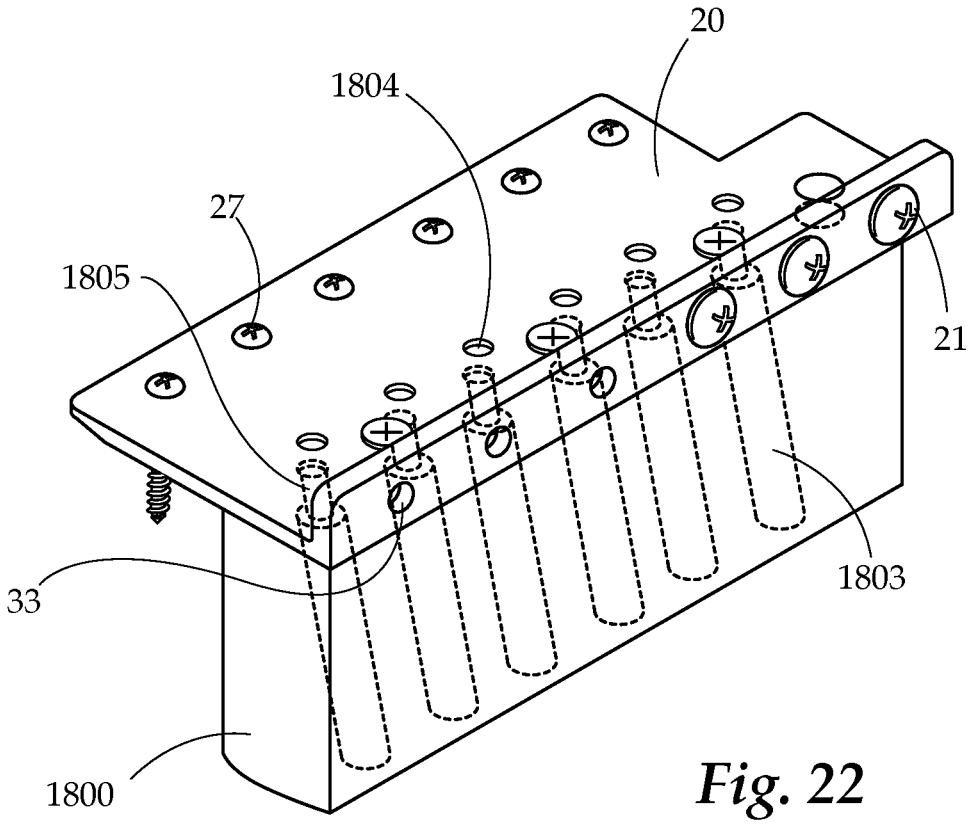
FIG. 22 is a plan view of the inertia block.
Figure 23:
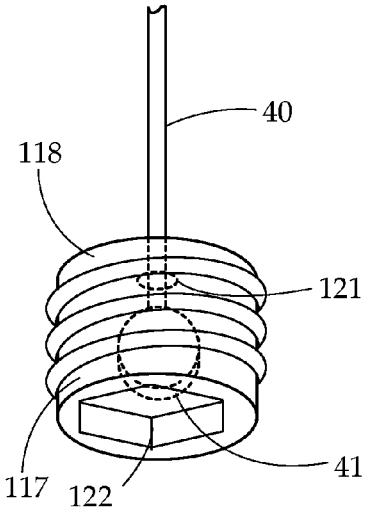
FIG. 23 is a plan view of the inertia block.
Figure 24:
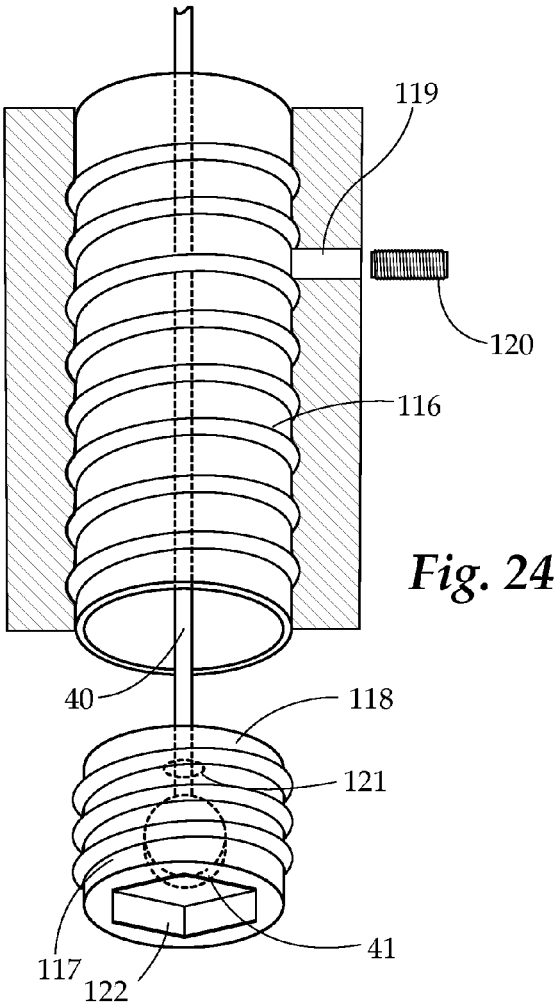
FIG. 24 is a top view of the interlocking bridge plate and inertia block system.
Figure 25:
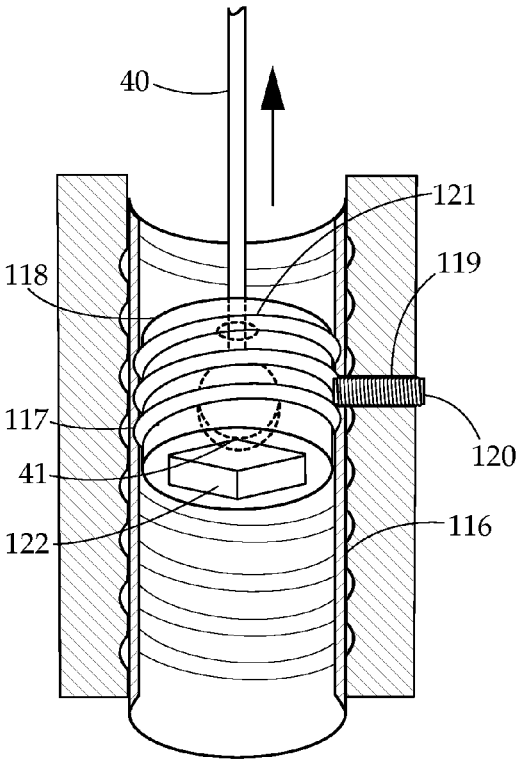
FIG. 25 is a musical string insertion chamber within the threaded inserts/string length adjusters.
Figure 26:
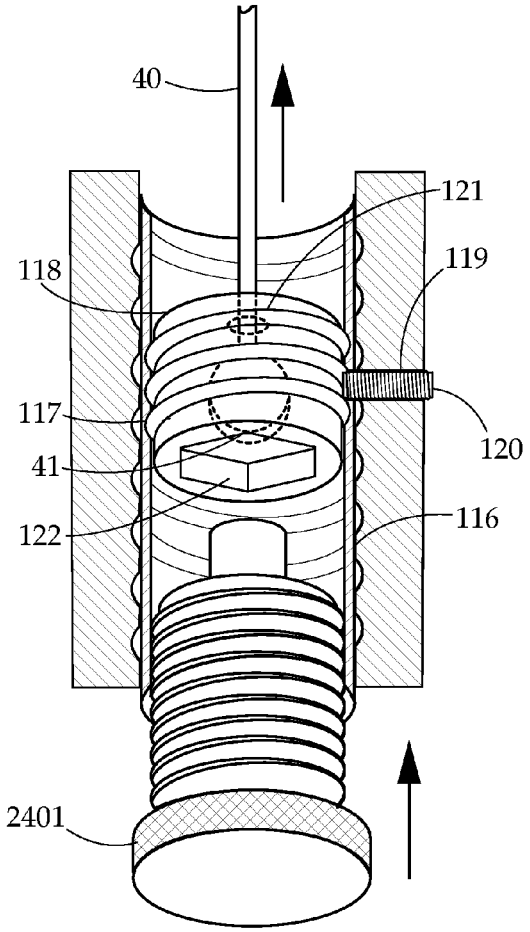
FIG. 26 is a musical string insertion chamber within the threaded inserts/string length adjusters.
Figure 27:
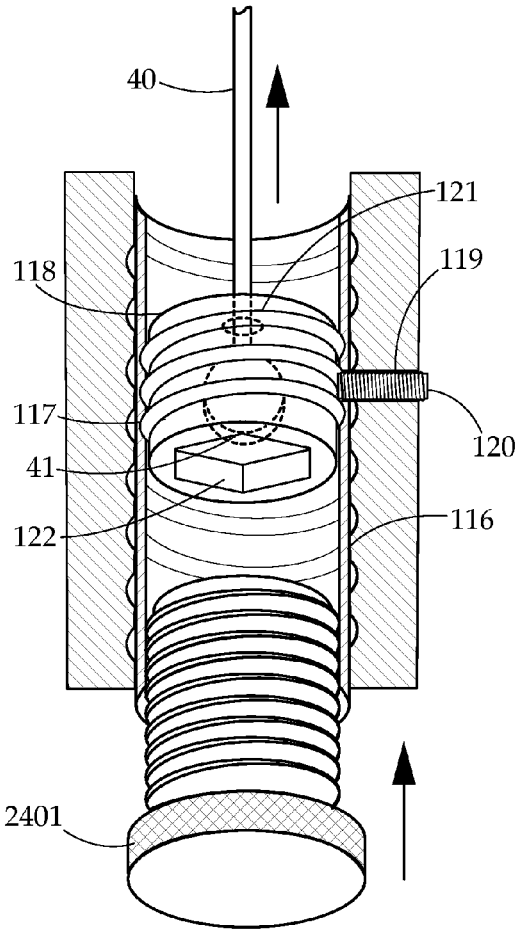
FIG. 27 is a musical string insertion chamber within the threaded inserts/string length adjusters.
Figure 28:
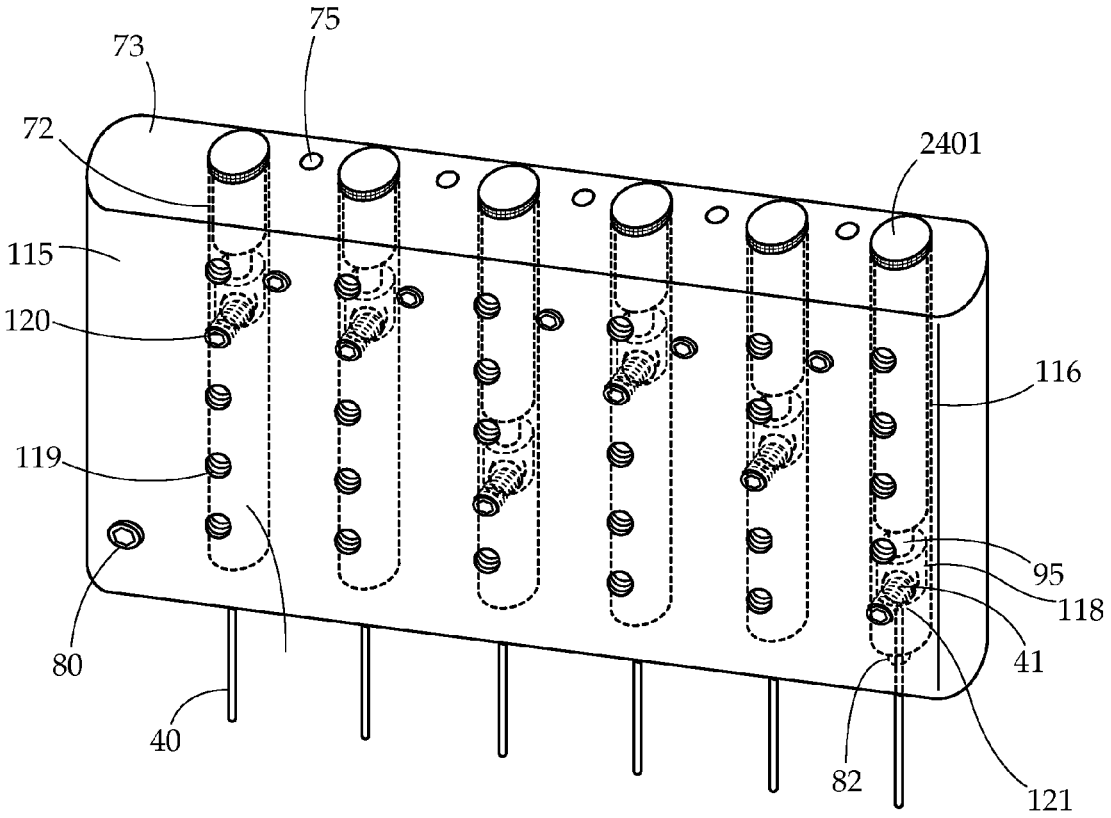
FIG. 28 is a musical string insertion chamber within the threaded inserts/string length adjusters showing physically locking pin type bolt.
Figure 29:
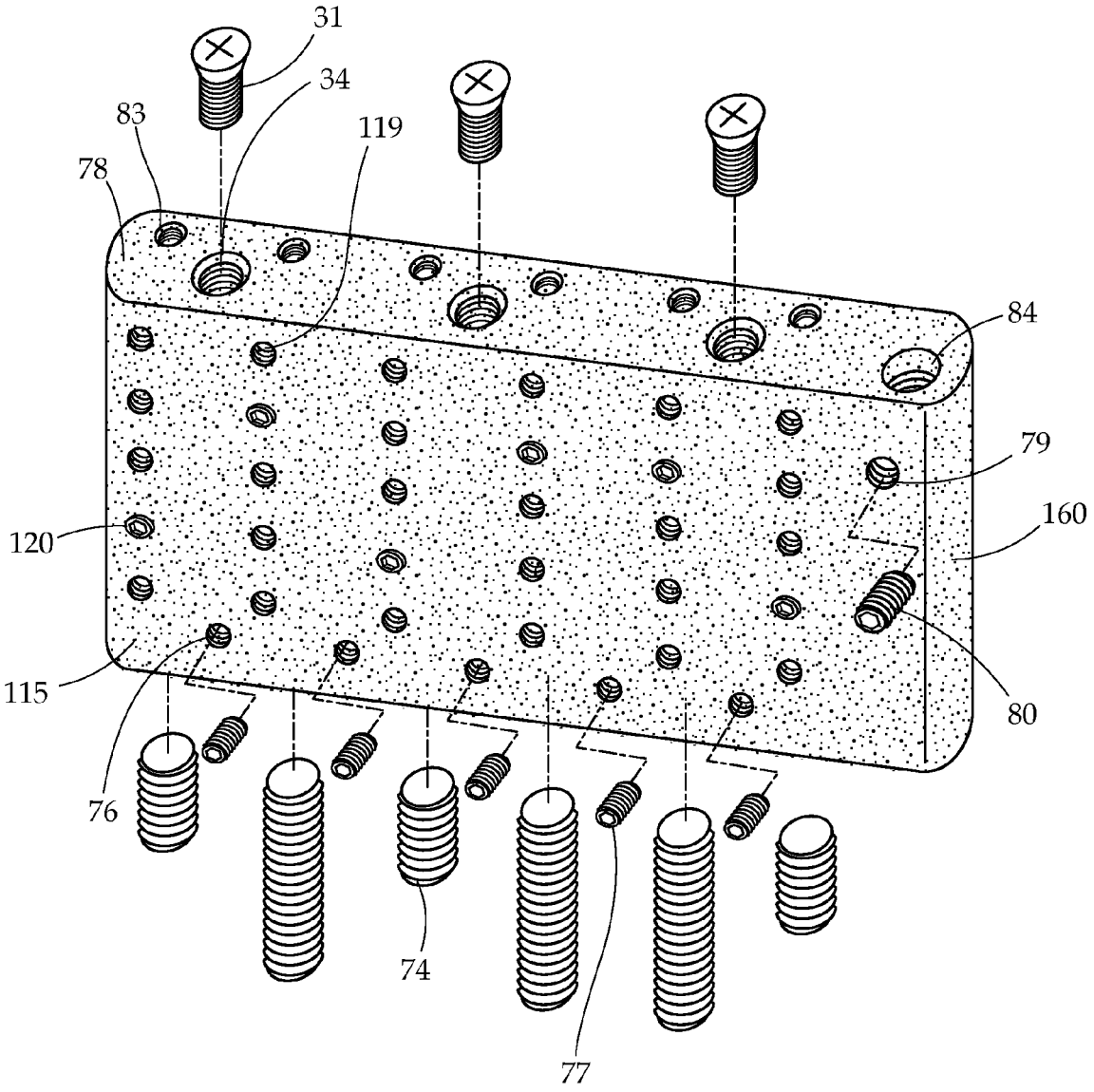
FIG. 29 is a musical string insertion chamber within the threaded inserts/string length adjusters showing spatially locking flat type bolt.
Figure 30:
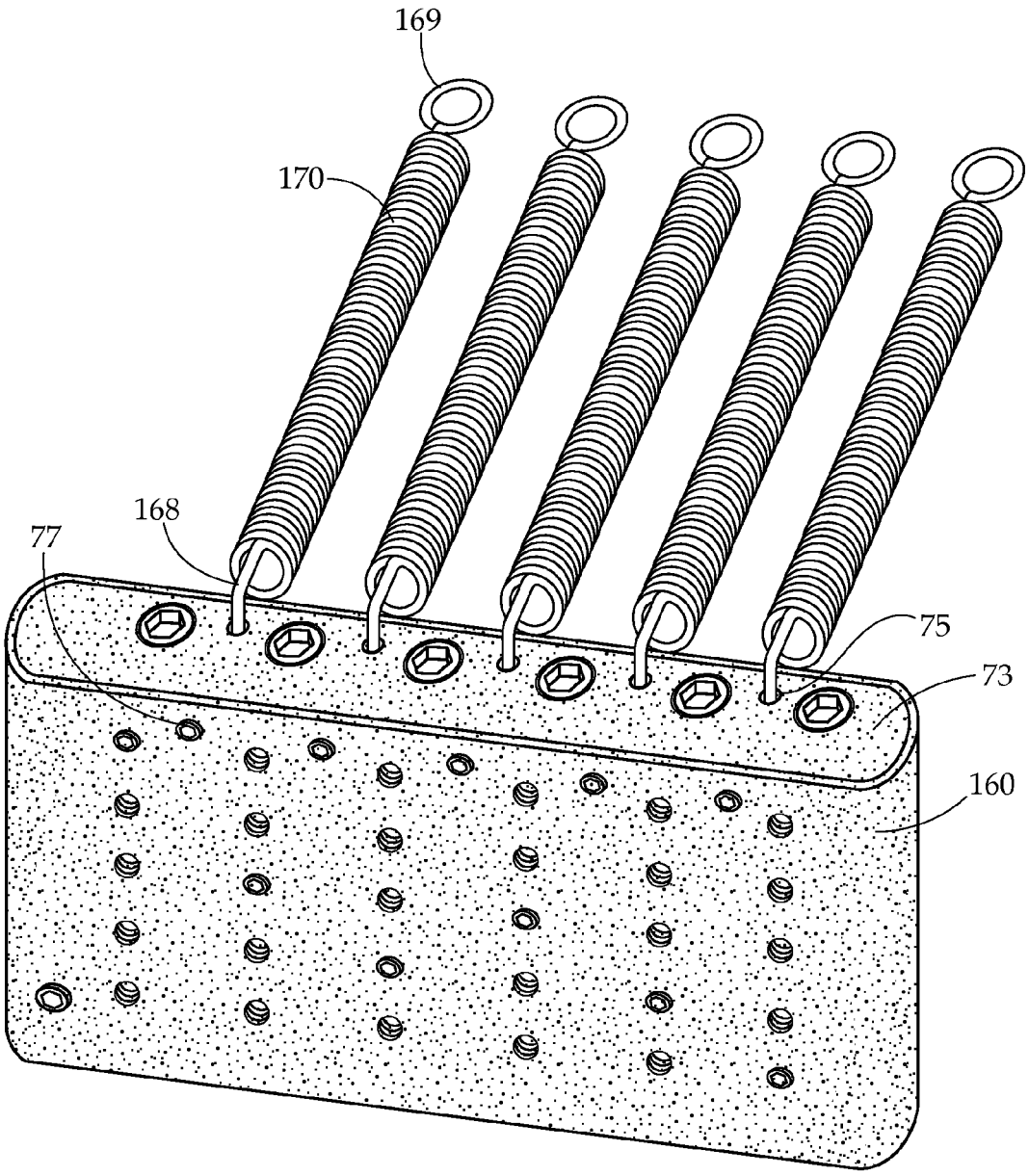
FIG. 30 is a bottom view of chambered inertia safety block showing fully bottom locked strings.
Figure 31:
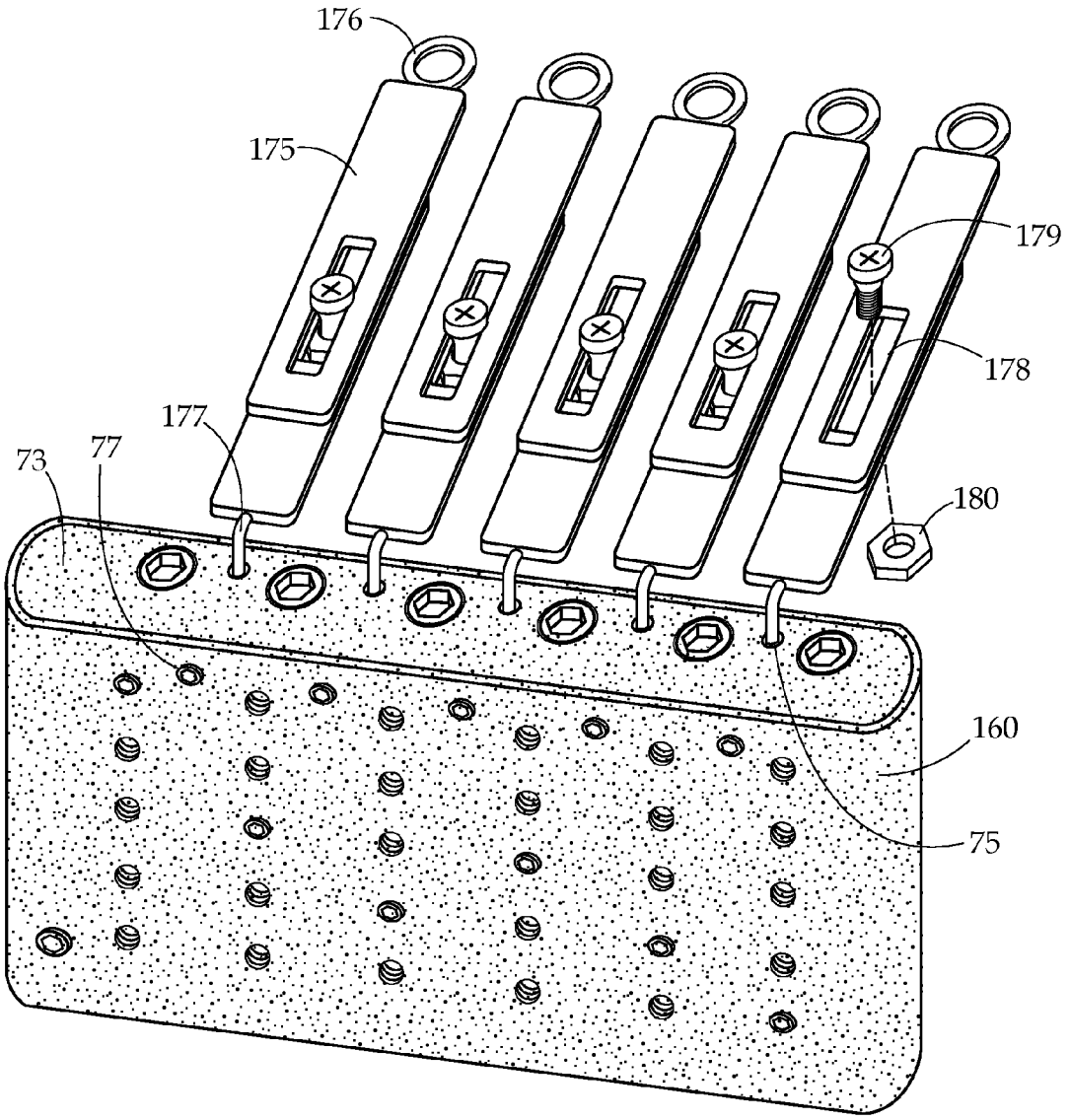
FIG. 31 is a bottom view of chambered inertia safety block showing shock/vibration absorbing material on entire block.
Figure 32:
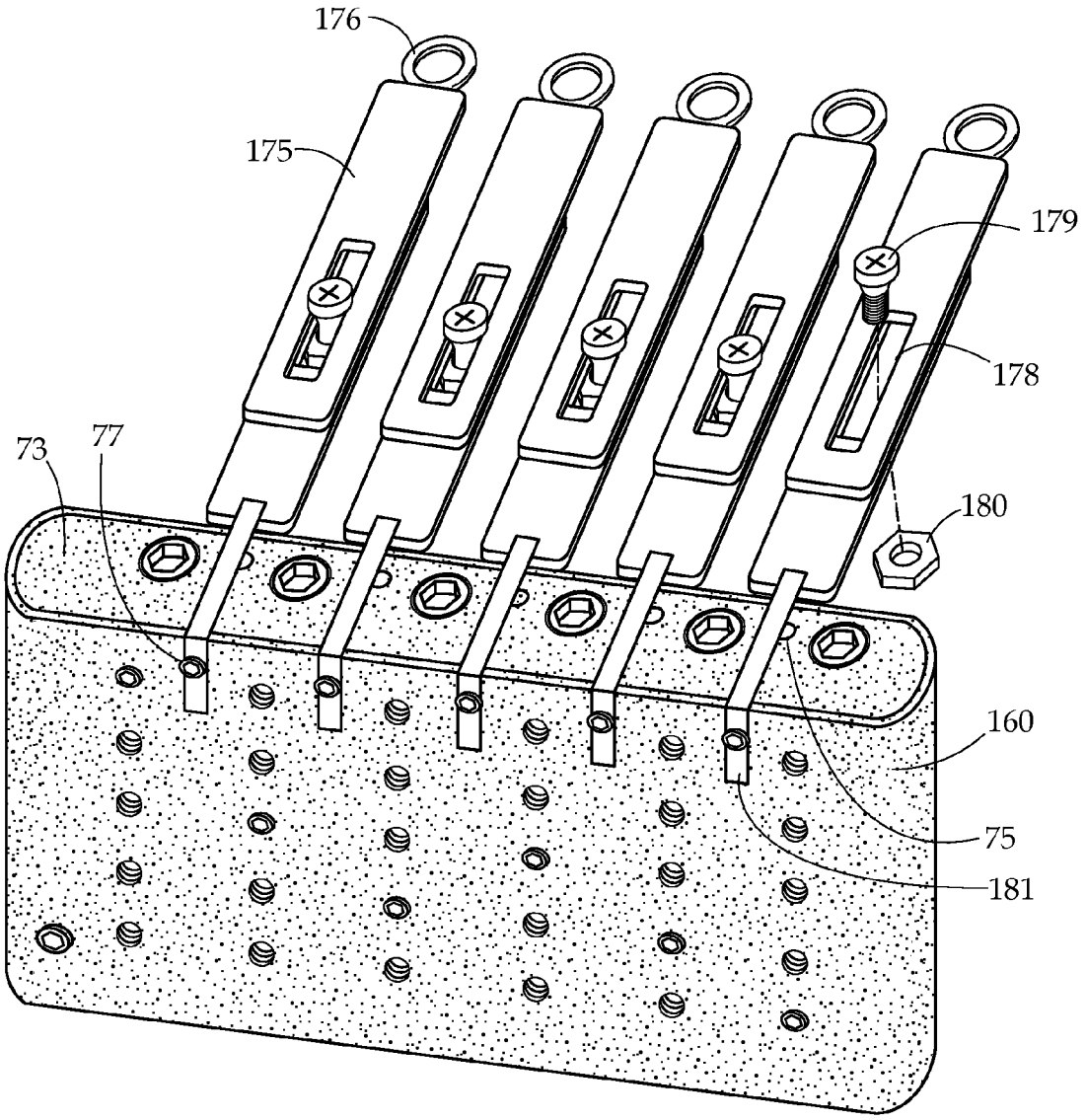
FIG. 32 is a bottom view of chambered inertia safety block showing the flatstock/tremolo stabilizers on block with shock/vibration absorbing material.
Figure 33:
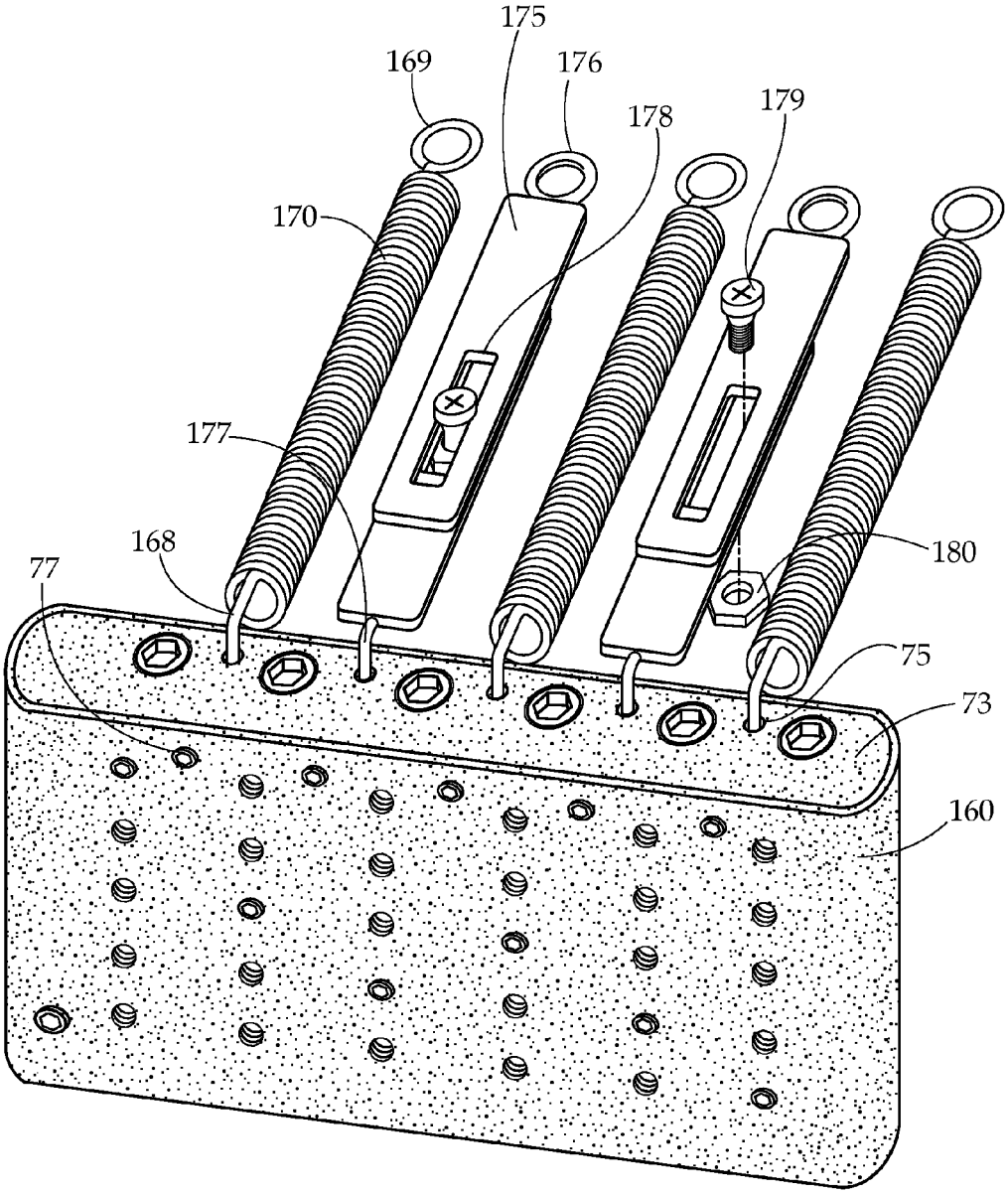
FIG. 33 is a bottom view of flatstock/tremolo stabilizers combination height adjuster/access fastening point to inertia safety block.
Figure 34:
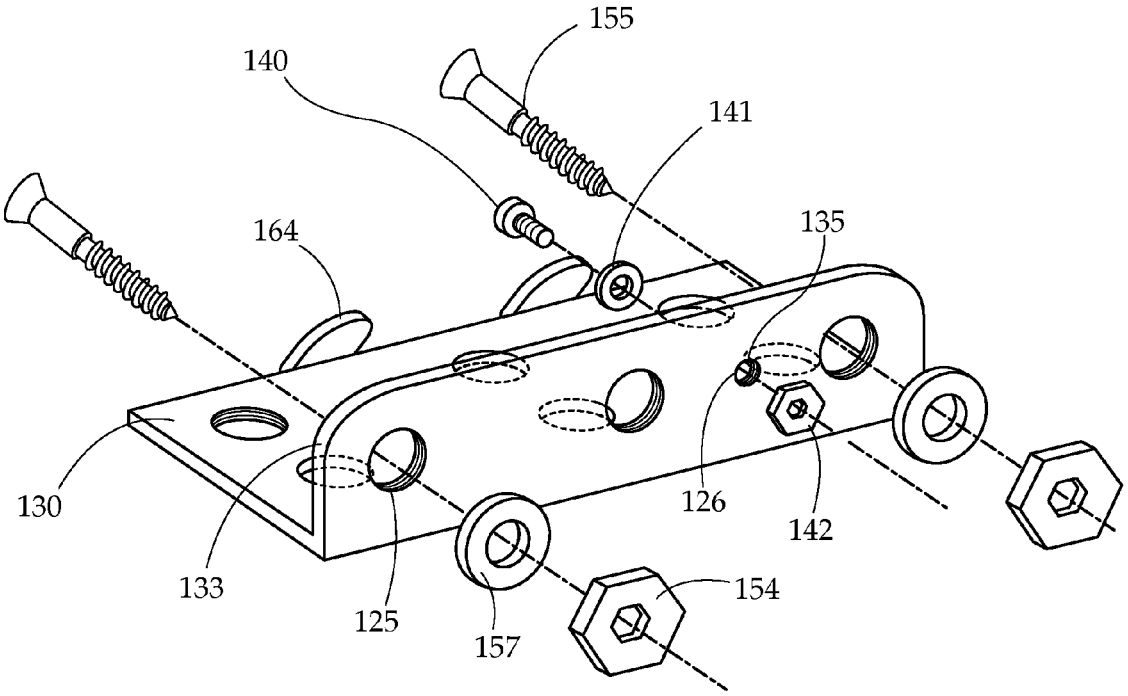
FIG. 34 is a bottom view of chambered inertia safety block showing combined spring and adjustable flatstock/tremolo stabilizers.
Figure 35:
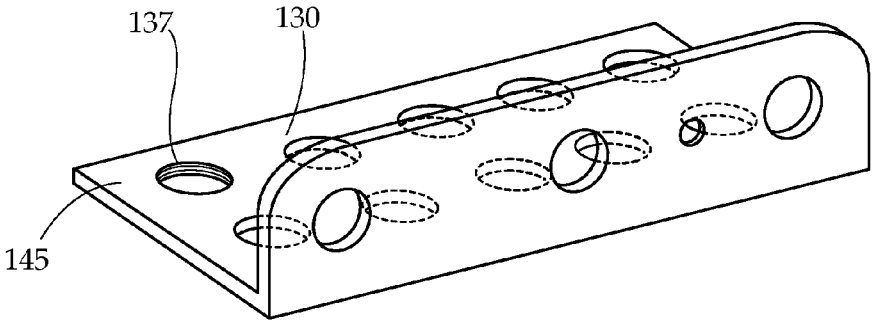
FIG. 35 is a top view of single tier safety claw.
Figure 36:
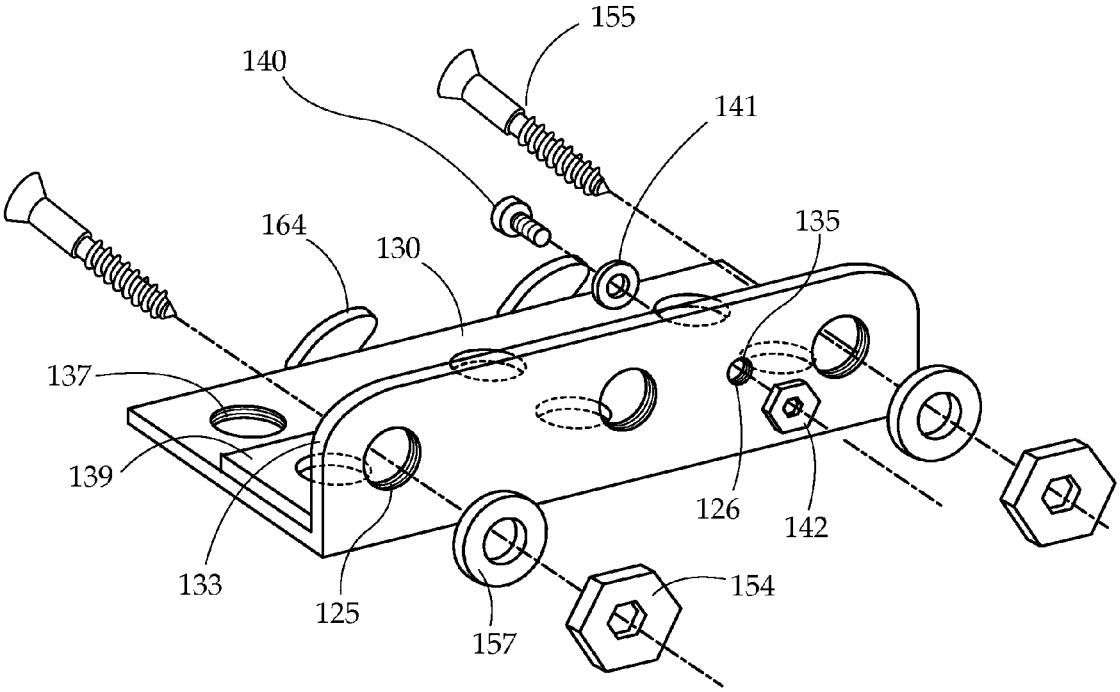
FIG. 36 is a plan view of 1 tier safety claw with 2 rows of threaded mounting holes.
Figure 37:
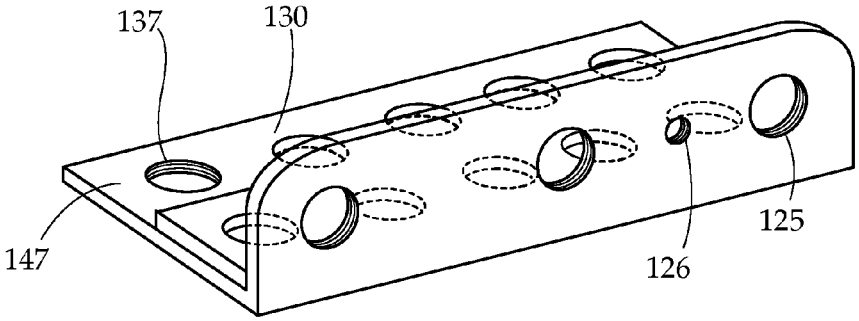
FIG. 37 is a top view of a double tier safety claw.
Figure 38:
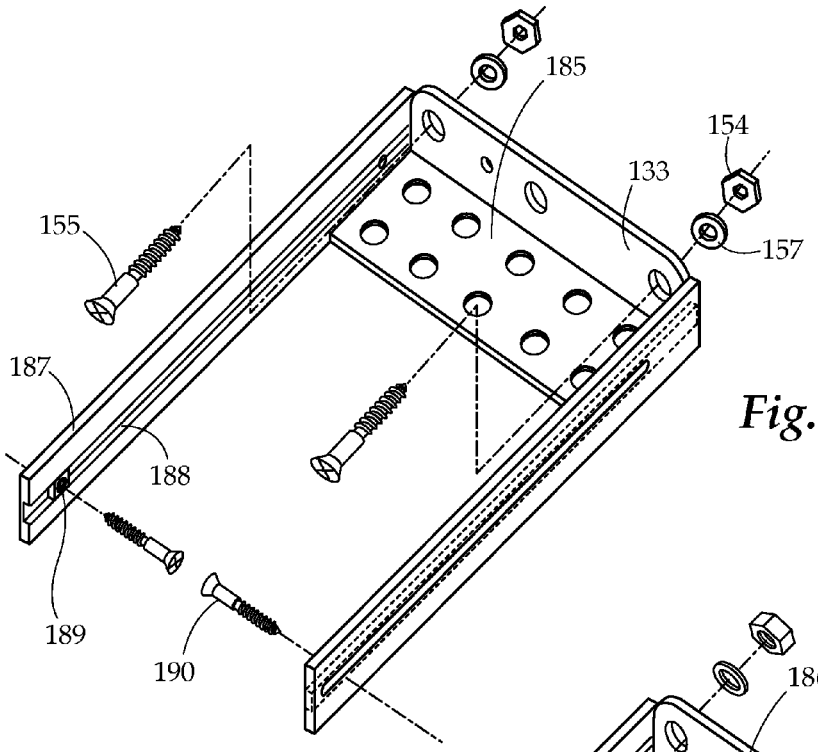
FIG. 38 is a plan view of 2 tier safety claw with 2 rows of threaded mounting holes.
Figure 39:
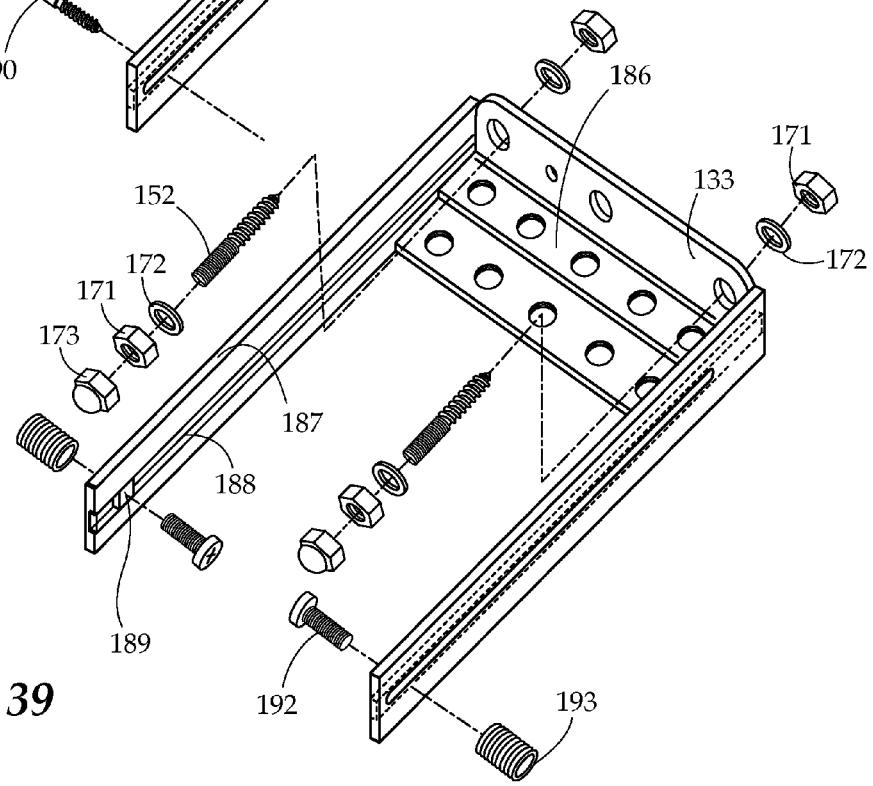
FIG. 39 is a plan view of a locking 1 tier safety claw with integrated dual rail system.
Figure 40:
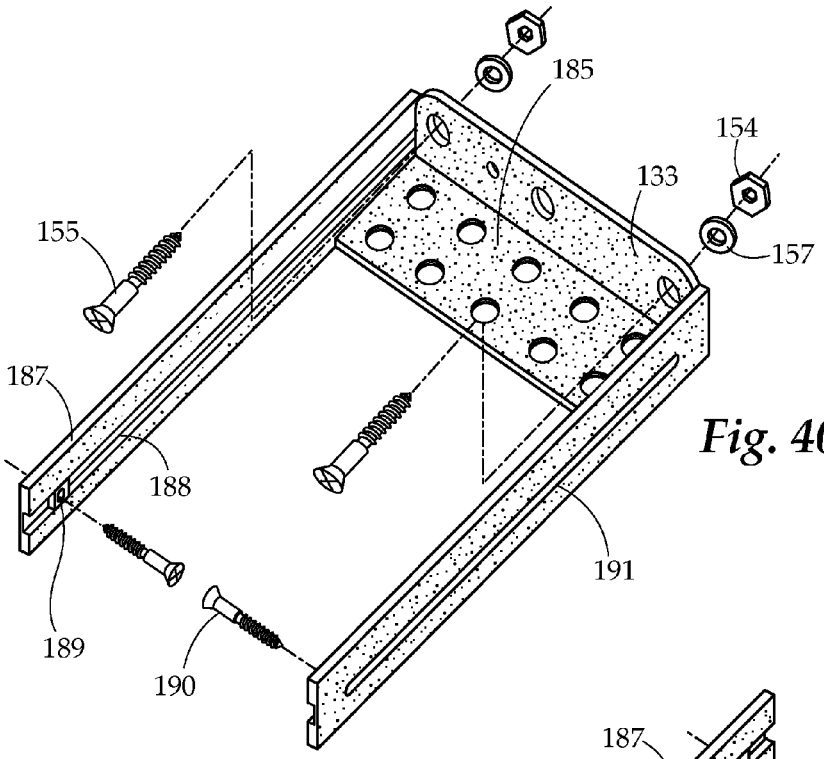
FIG. 40 is a plan view of a locking 1 tier safety claw with integrated dual rail system covered in shock/vibration absorbing material.
Figure 41:
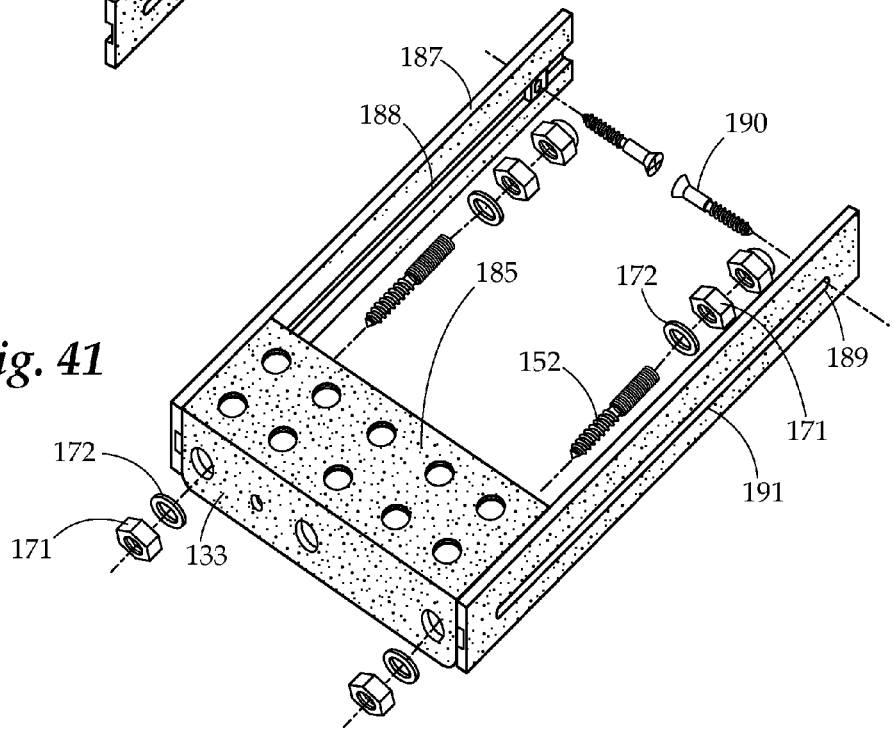
FIG. 41 is a plan view of a locking 2 tier safety claw with integrated dual rail system.
Figure 42:
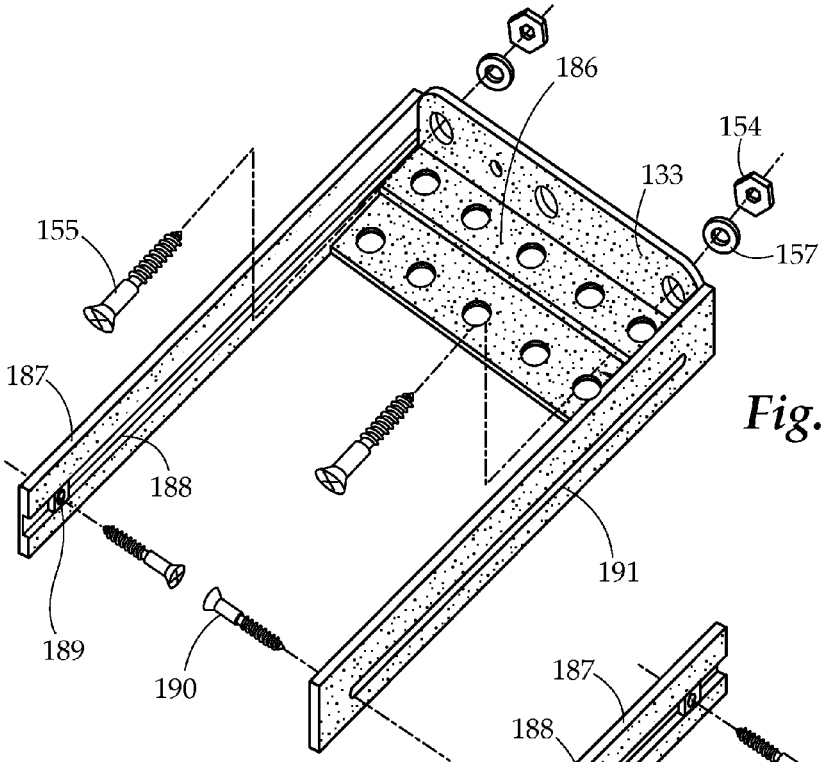
FIG. 42 is a plan view of a locking 2 tier safety claw with integrated dual rail system covered in shock/vibration absorbing material
Figure 43:
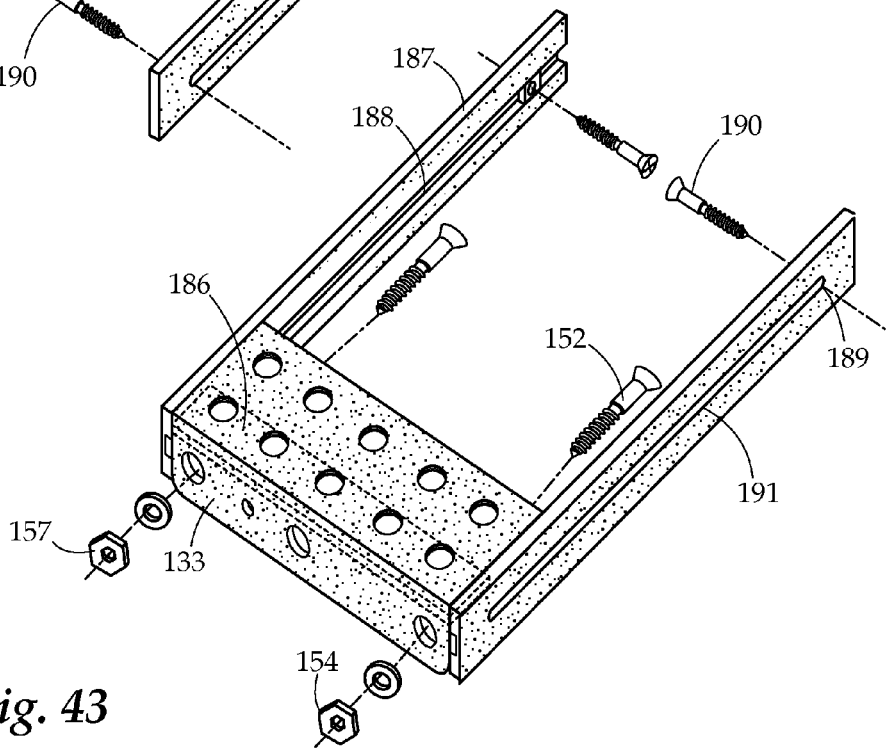
FIG. 43 is a rear view of a 1 tier-2 row safety claw.
Figure 44:
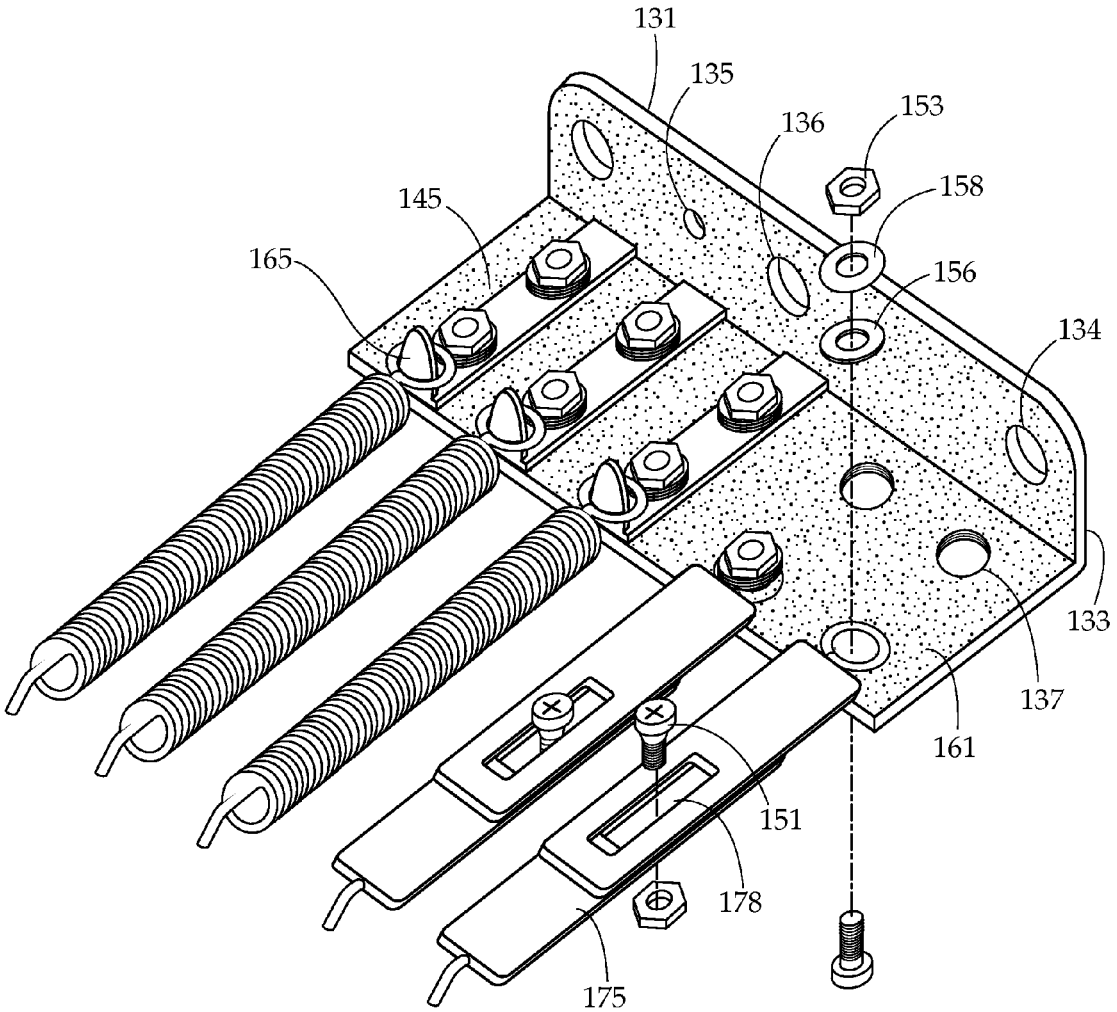
FIG. 44 is a plan view of an integrated 1 tier "box style" safety claw and rail combination claw.
Figure 45:
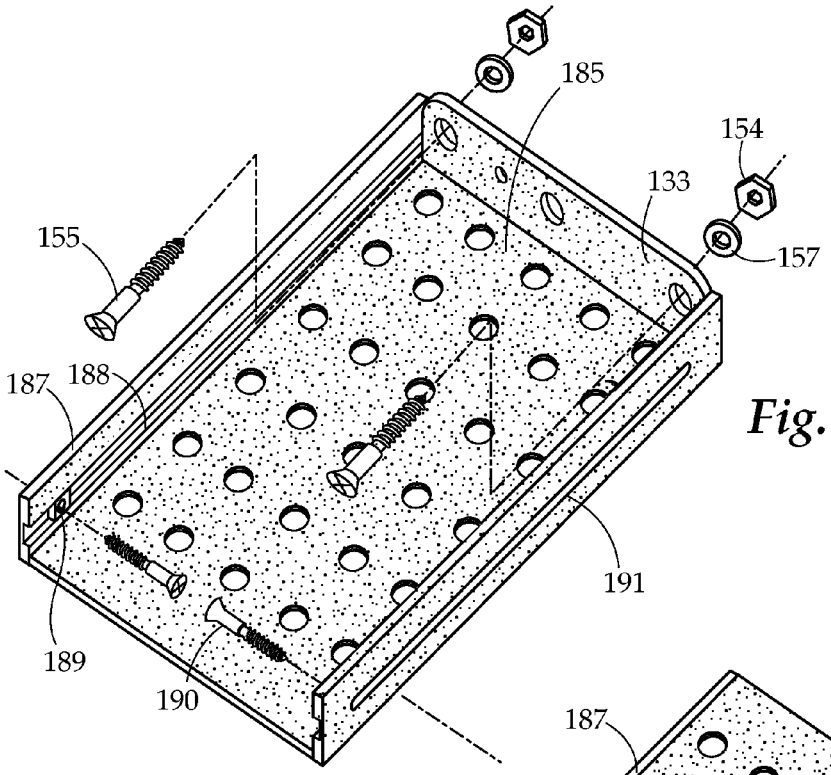
FIG. 45 is a plan view of an integrated 2 tier "box style" safety claw and rail combination claw.
Figure 46:
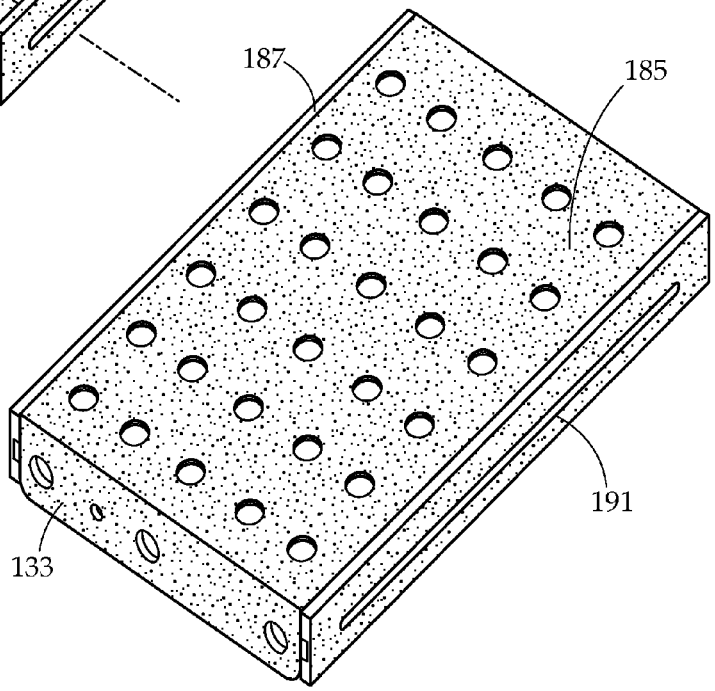
FIG. 46 is a rear view of a 2 tier-2 row safety claw.
Figure 47:
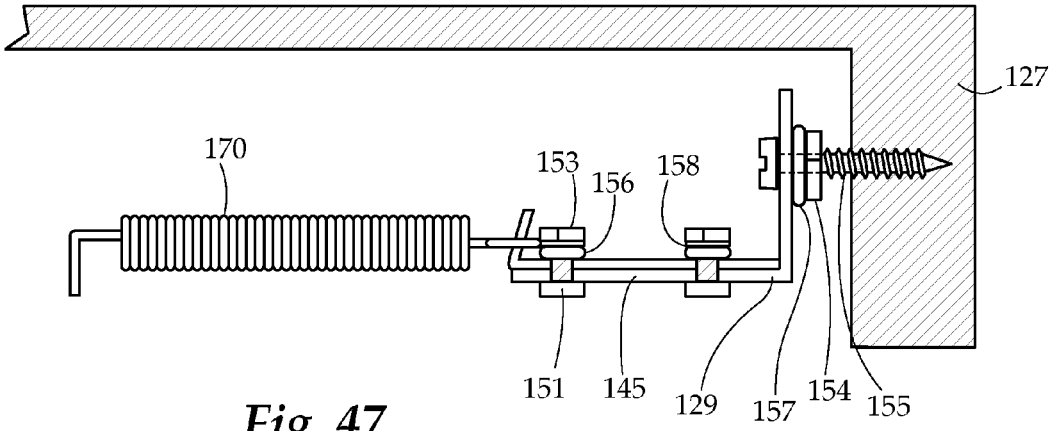
FIG. 47 is a rear view of a 2 tier-2 row safety claw.
Figure 48:
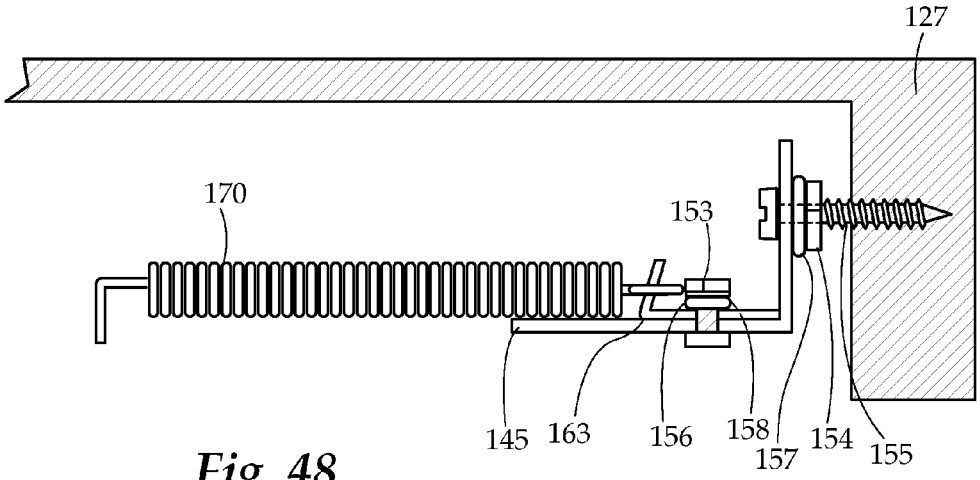
FIG. 48 is a side view of a single tier safety claw with single row claw and spring
Figure 49:
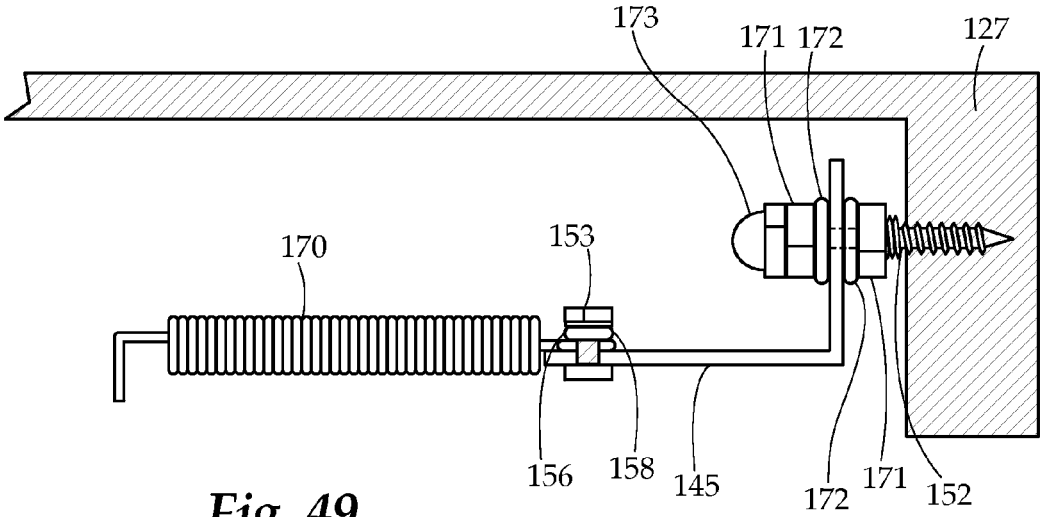
FIG. 49 is a side view of a single tier safety claw with 2 piece adjustable flatstock/tremolo stabilizers.
Figure 50:
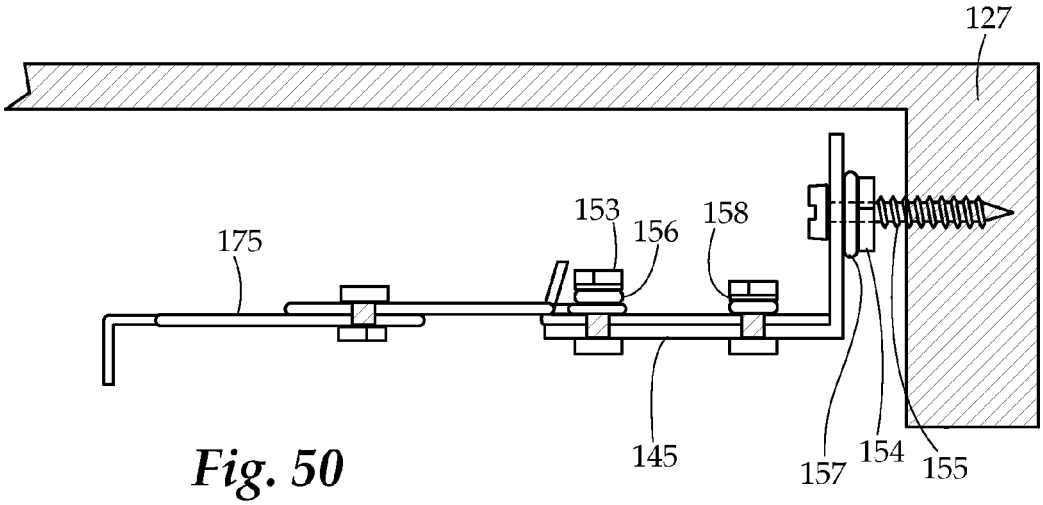
FIG. 50 is a side view of a single tier safety claw with double row claw and spring.
Figure 51:
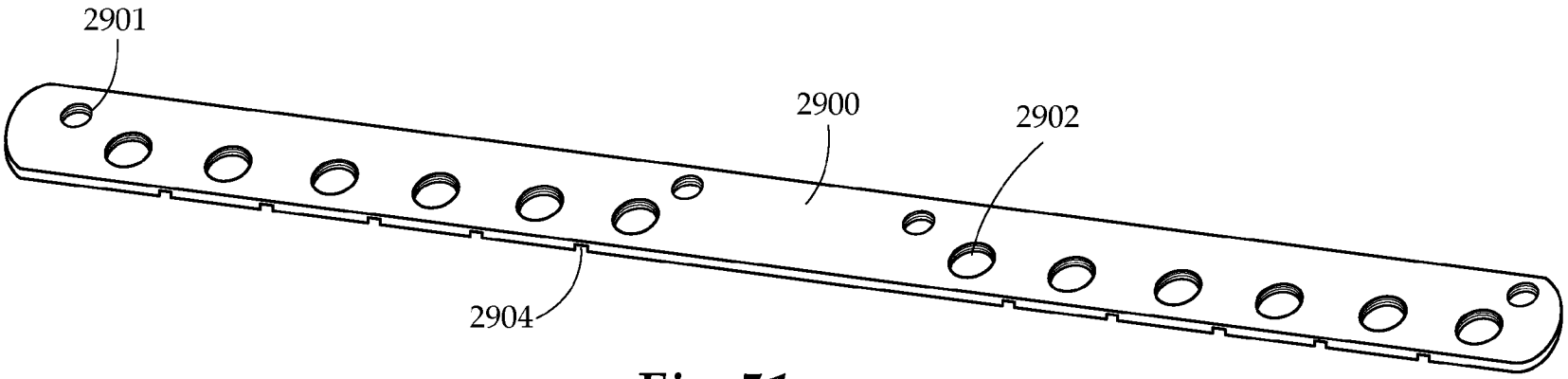
FIG. 51 is a side view of a single tier safety claw with double row claw with spring and adjustable flatstock/tremolo stabilizers.
Figure 52:
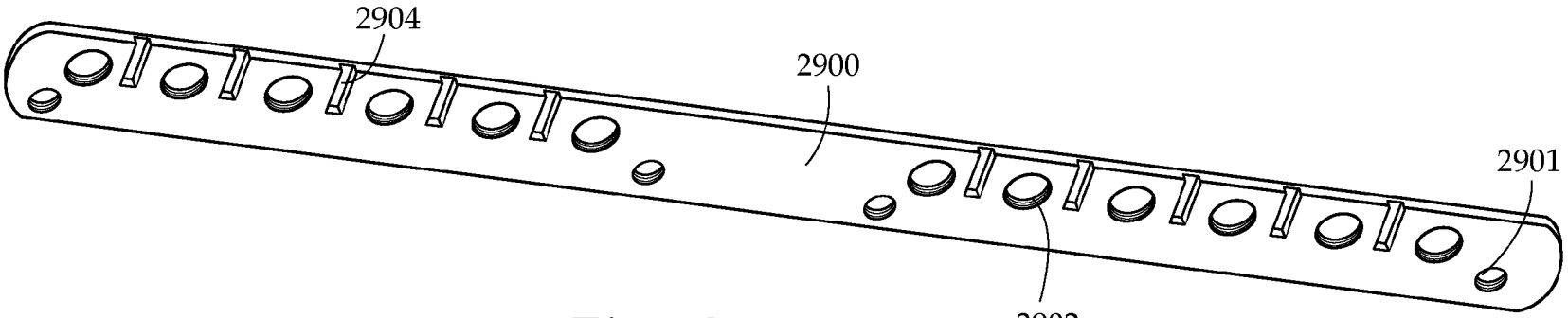
FIG. 52 is a side view of a single tier safety claw with double row claw and 2 piece adjustable flatstock/tremolo stabilizers.
Figure 53:
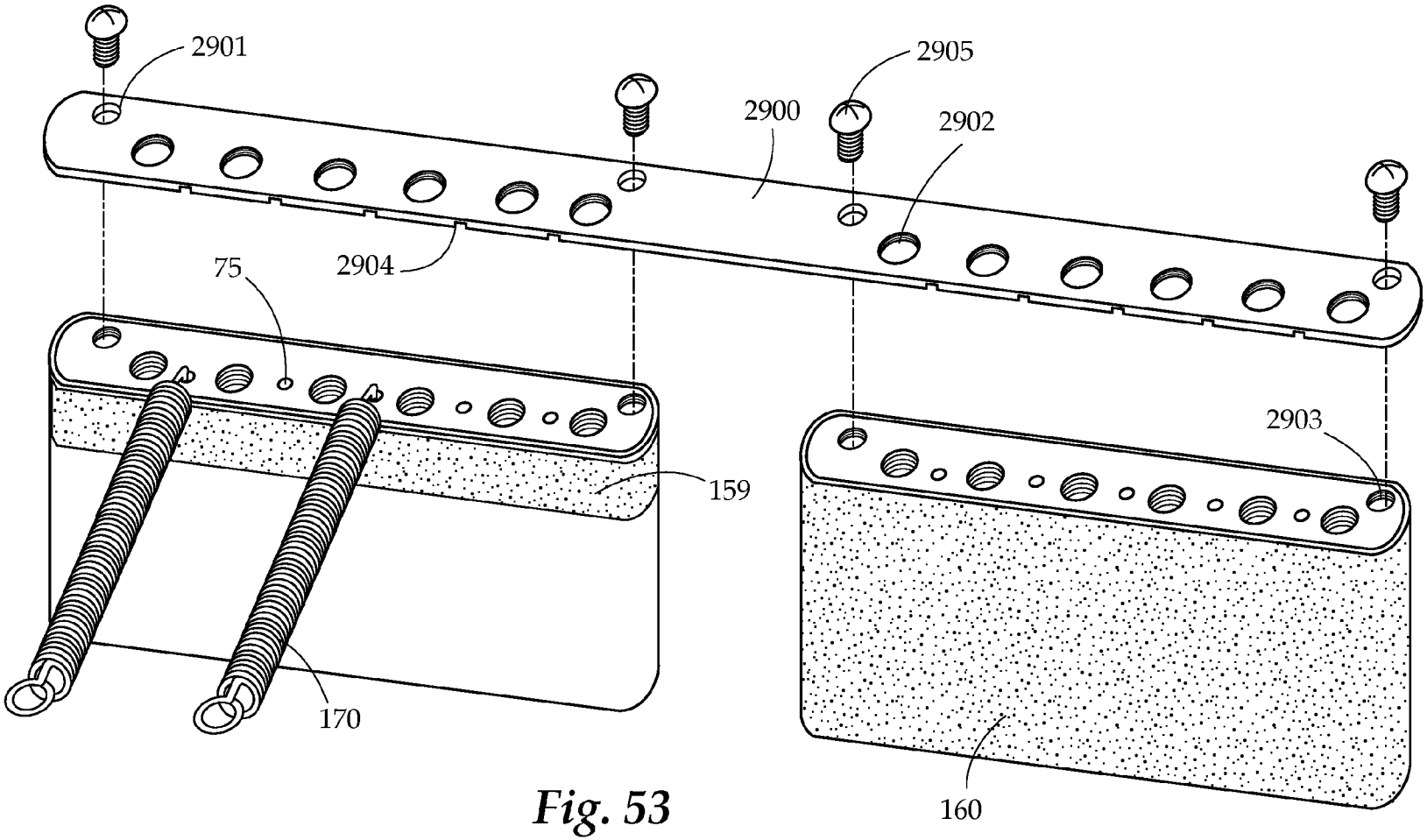
FIG. 53 is a side view of a double tier safety claw with double row claw and spring.
Figure 54:
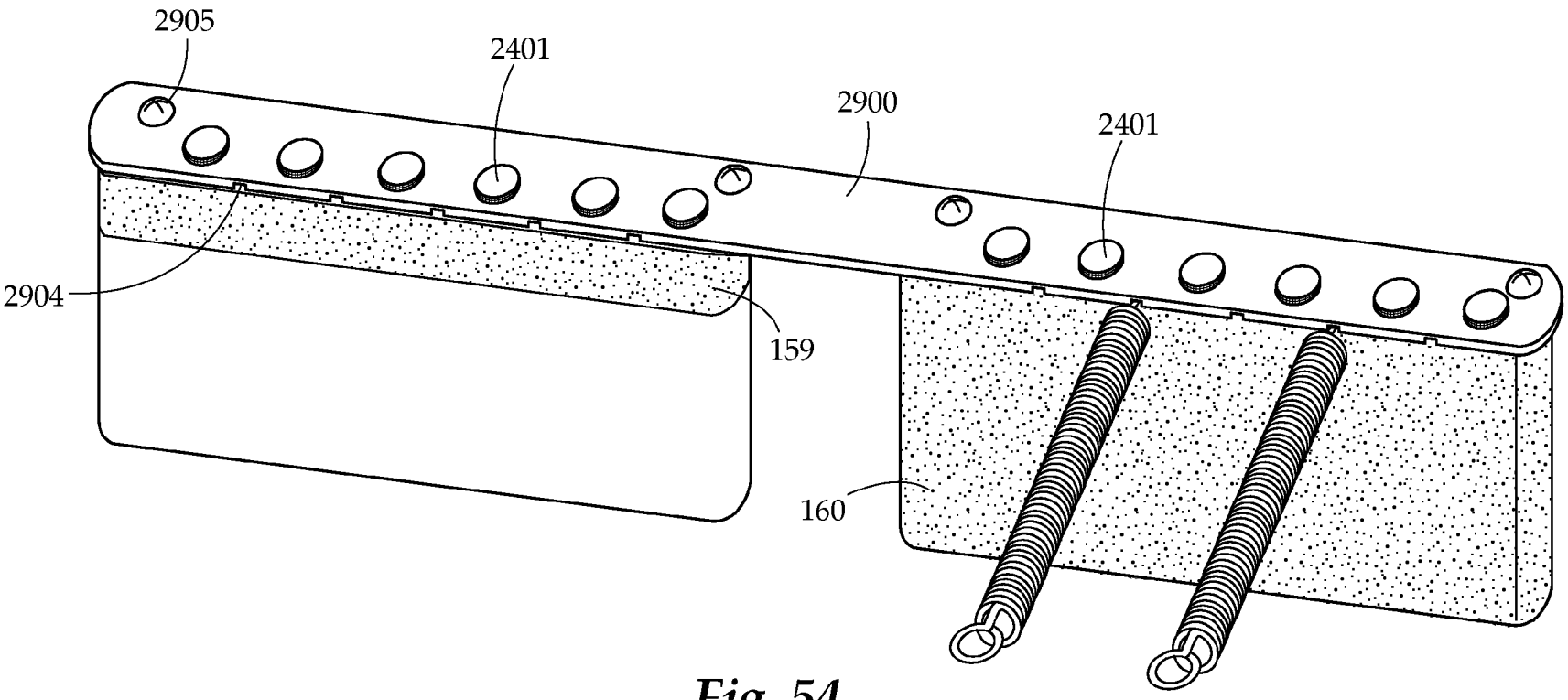
FIG. 54 is a side view of a double tier safety claw with double row claw and 2 piece adjustable flatstock/tremolo stabilizers.

In one embodiment, the tremolo system utilizes a spatial control design and mechanism in order to prohibit string movement by spatially locking the string within the tremolo inertia block, also known as the tremolo block or string chamber 82, creating two options for tuning stability. The inertia block has an upper threaded chamber 71 and a lower threaded chamber 72. Additionally a spring coupling chamber 75 is located within the inertia safety block. The ball end 41 of the string 40 is secured with the retaining mechanism against the upper wall of the string retaining chambers 82, such that the retaining mechanism physically makes contact with the ball end 41. A threaded chamber 76 for a locking set screw mechanism 77 to lock the springs 40 is located within the chamber. A user controls the closeness of the retaining mechanism to the ball end 41. Preferably, threaded screws or fasteners and a threaded tapped block are used.

Alternatively, a bottom locking bolt mechanism 74 is used for the ball end of the string. The fasteners may be made of titanium, aluminum, brass, steel, and other metals, composites and such materials. The choice of fastener material is based on the tone and weight of the bridge system. In one embodiment the chamber in the inertia block 1800 is angled and threaded between up to sixty-five percent of the inertia block 1802 disposed to reduce the break angle of the string when passing through the inertia block 1800 and the bridge plate 507. In this embodiment the chambers are offset by approximately a number if degrees, that may range from one to three degrees or greater reducing stressors and providing improved tuning range. In an alternate embodiment the chamber is treaded up to one hundred percent of the block 1803. The angled and threaded string chamber has a angled chamfered string exit aperture 1804 and an angled string exit chamber 1805.

In an embodiment, the tremolo system comprises a preformed inertia block wherein the block cavity comprises an additional integral cavity disposed to accept the tremolo springs. A locking screw permanently secures/locks the spring end to the tremolo spring cavity. The springs can be screwed down by the loop end or the "L" shaped end.

In one embodiment, a swivel string end 45 comprises metal tabs either press fitted, snapped, or locked into place by the opposing sides of a mechanically rotated metal chamber. The mechanized chamber rotates and adjusts the swivel end string. This embodiment is adaptable to both fine or course threaded string chambers 82. In an additional embodiment, threaded set screw inserts or spacers comprise hollowed out center cavities providing control of various parameters including individual string length, guitar tuning when the tremolo is raised or depressed, and string tunings in correlation to adjacent strings. The spacers can be made of various materials such as brass, steel, titanium, synthetic materials, composite materials or the like. Preferably the top of the spacer screw may be a hex head or the like. In six-in-a-line type tuners on a headstock (for example purposes only which are not within the tolerances of a 1½" steel inertia block), the string length/tolerance is equal between the bridge and the nut, therefore adjustments within the inertia block fall within the tolerances of adjustability for tuning stability throughout the range of the tremolo, allowing for tonal control.

The string is locked into place spatially through the center of the ball end string 42 or wound/knotted string loop. Alternatively, the string is locked physically 95 through the central of the ball string or wound/knotted string loop. The locking string has a threaded end 47. In addition, integrated bearings 67 are disposed to hold the string within the locking string housing. The bearings 67 are attached through a bearing cavity 68 in the inertia block. The housing is threaded further comprising a hex head 48, or the like, integrated in the bottom of the string end to fasten to the bridge plate. Alternately, swivel style bearings hold the string within the chamber 49. A hex head, or the like, is integrated on the string end to secure the string to an instrument bridge plate. The swivel style bearing 39 is disposed to allow rotating performance throughout a conical range of motion. The integrated bearings 39 further comprise integrated knurled ends for the string disposed to allow the strings to be locked by hand.

In an embodiment, the locking tremolo system comprises parts creating added bridge mass with enhanced sustainment qualities. In such an embodiment a steel, brass, titanium, carbon fiber, or mixture thereof brackets/flatstock is used in place of springs. The brackets are adjustable in length when utilized in conjunction with springs. The flatstock or the material chosen is locked to the claw. If the flatstock is utilized in conjunction with the spring, a fixed bridge may also be utilized as a tremolo/vibrato stabilization device. In such a manner, the steel materials would add more mass to the system, thus enhancing sustain and tone. In another embodiment, the tremolo system does not require a locking mechanism to initiate direct contact with the string, instead engages the ball end placed at the trailing end of the string within the inertia block mechanism. In such an embodiment, "zero" space exists within the non-locking tremolo system. Constant pressure on the ball end reduces the stress and strain tensors, preventing loosening of the ball end when the tremolo is depressed.

In an additional embodiment, the tremolo claw and springs are locked to the block by way of spring holes in the block, creating a quadruple locking system. This system may be utilized with a single tier claw with a single or double row claw or a double tier claw with a single or double row claw. The quadruple locking system further comprises locking tuners, a locking bridge, locking springs, and a locking tremolo claw. A modified nylon nut 154 secures the wood screw 155 that secures the claw to the tremolo cavity 150. The tremolo claw stabilizer comprises a locking system for a vintage inertia block system. The locking system utilizes a hanger bolt or other such mechanism comprising a hybrid of a wood screw and machine screw. The wood screw portion affixes the claw to the guitar cavity. Two steel screw nuts compress against the claw from both sides, locking the claw in place. Set screws further lock the springs at the inertia block. In an alternate embodiment, a two-piece adjustable flatstock is utilized in place of the spring. Shock absorbing material is attached to the block for metal-on-metal contact, reducing metal-on-metal vibrations. A plastic tremolo cover hides the tremolo cavity and block modification on the back of the instrument.

In another embodiment, the system comprises an individually mounted hook with a spring and an adjustable flatstock on a second row claw. Additionally, tremolo claw rails 187 are installed with the individually mounted hook 165. Optionally, the safety claw assembly can have integrated hooks 165. There may also be an offset on the individually mounted hooks 165 to prevent side to side movement while secured on safety claw.

In a preferred embodiment, the tremolo system comprises two rubber shock absorbers or friction absorbers such as grommets 156. The first of the two rubber shock absorbers is located on the wood screw 154 between the nylon nut 155 and the claw. A rubber washer 157 is also used in conjunction with the wood screw 154. The second of the two rubber absorbers is located between the claw and the spring. The area of the block that the spring enters comprises a self-stick rubber, eliminating metal on metal vibrations. Other shock absorbing or friction absorbing materials may be used. Other anti-vibration shock absorbing, natural or synthetic products may be utilized.

The tremolo device may comprise a block or inertia block mechanism further comprising a substantially solid construction and is disposed to receive and securely retain a plurality of raw instrument strings without removal of a ball end 41 from each individual string. The inertia block or block mechanism may comprise an upper block portion and a lower block portion, a plurality of internal, longitudinally displaced, cylindrically shaped or tubular string retaining chambers designed to pass through an entirety of said block mechanism. The plurality of longitudinally displaced cylindrically shaped string retaining chambers may further comprise an upper portion and a lower portion corresponding to the upper and lower portions of the block mechanisms to allow said string 40 to pass through the upper portion while simultaneously retaining the ball end 41 of the string.

The block mechanism further comprises a plurality of corresponding locking mechanisms wherein the plurality of cylindrically shaped string retaining chambers are disposed to receive the plurality of corresponding locking mechanisms and the plurality of corresponding locking mechanisms disposed to increase upwardly along the length of the cylindrically shaped string retaining chambers toward the upper portion and toward the ball ends of the individual strings.

The locking mechanisms behave in a screw-like nature, such as allen screws, rotatable down a threaded shaft along the length of the cylindrically shaped string retaining chambers. Hex head" machine set screws, or round "knurled" screw designs may be utilized and knurled screws which will allow a person to lock the string by hand instead of using an allen wrench. The tubular or cylindrical retaining chambers may be threaded to receive a retaining or locking mechanism. An allen type screw, in conjunction with a beveled mating area, may be utilized in order that the trailing edge of the retaining mechanisms become flush with the instrument casing upon depression of the retaining mechanisms in the partial retention or full retention position. In one embodiment, the retaining mechanism may be increased for the mechanism to come in contact with the trailing edge of the ball end of the string without crushing the ball end of the string. Thus, the system locks with the minimal amount of force necessary to secure the string. This prevents stressors made to the ball end of the string, therefore preventing the ball end from being contorted or damaged during the string locking procedure in a manner of physically locking.

In another embodiment, the user may be afforded control of the proximity with which the retaining mechanisms comes to the trailing edge of the ball end of the musical string. The retaining mechanism is brought close enough to secure or restrain motion of the string and ball end of the string, providing a locking function without needing constant contact with the ball end of the string, spatially locking the string. This embodiment allows the user to precisely control the ball end movement, in relation to the retaining mechanisms and the ball end within the tremolo block. The retaining mechanism should contact and securely retain the ball end of the musical strings against the upper portion of the internal longitudinally displaced cylindrically shaped string retaining chambers, and is disposed to securely retain the ball end of the strings to the plurality of internal, longitudinally displaced, cylindrically shaped, string retaining chambers. The system can be used with all market available strings.

To install a new string the portion opposite the ball end, the open end, is inserted into the individual tubular or cylindrical retaining chamber located on the lower or bodily inward facing side of the instrument. The string is fed through the retaining chamber, out the upper portion and across the saddle, to be threaded across the frets and secured. Once the string is aligned through the string retaining mechanism, either prior to or following the reefing process, the retaining mechanism is decreased down the cylindrical retaining chamber. The individual locking screws are directly inserted through the bottom of the instrument.

The tremolo bride plate is secured to the tremolo block and normally held together by machine screws, as known in the art. The saddles are connected to the tremolo bridge plate. In front of the tremolo bridge plate are two pivot/knife edges 26. The bridge plate pivots on two screws, which have a "v" shaped indentation so the bridge plate can pivot as a fulcrum point. Brass inserts/bushings may be mounted into the instrument body, and the screws are affixed to the brass inserts/bushings. These screws adjust the height of the tremolo bridge plate off the instrument face. Optionally, a tremolo arm 28, or whammy bar apparatus, may be affixed by screws 80 into the block via a hole 79 on the top of the bridge plate. The tremolo arm also has a tension screw 30 and an arm tip 29. In one embodiment, the tremolo base plate comprises oversized or oval shaped string exit holes 35 to eliminate string contact with the bridge plate, eliminating a friction point.

In one embodiment, at least one tremolo spring 170 may be attached to the bottom of the inertia block. However, one to five spring may be utilized, depending on user preference. Five cylindrical apertures are located on the bottom of the inertia block to accept the tremolo springs. The springs 170 attach to the claw, attached into the wood area 127 of the tremolo cavity 150 of the instrument by two wood screws 155. The steel wood screws and springs are disposed to compensate for string tension and tremolo playability.

The instant tremolo system further comprises generally a base plate, wherein the base plate is disposed to mate directly with the musical instrument in order to restrain the system in the proper position within the face of the instrument. A string retaining inertia block or block mechanism extends downwardly from the base plate. The base plate comprises knife-edge 510 sections adjacent to each of the forward side corners of the tremolo device. The tremolo device is adapted to be mounted on stringed instruments by means of set screws or similar fastening mechanisms which are fixed to the body of the guitar and have tapered grooves for receiving the knife edge sections on the tremolo device sot that the base plate is generally aligned parallel to the top surface of the instrument.

Further illustrated is a bottom view of the tremolo system, depicting the bottom face of the instrument. In this regard, the block extends downwardly to a cavity in the body of the instrument and comprises a horizontal spring or springs connected to the bottom portion of the block thereof to balance the tremolo device against the action of the musical string that are secured to the tremolo device.

In an alternate embodiment, the retaining chamber house a restriction mechanism located in the upper portion of the retaining chambers disposed to decrease down the retaining chambers allowing a great amount of string within the retaining chamber. The restriction piston rides on a shaft and is controlled by a knob located on the outer, lower portion of the inertia block. In this embodiment, the retaining members comprise a central bored out area to allow the shaft to move up the center of the retaining chambers.

In a further embodiment, the tremolo system may comprise a hard bracket for mounting the strings for the whammy bar to be actuated by being pushed against the user's body. A threaded string end 1603 fitted into a corresponding female fitting disposed to provide better tonal control may be used. Additionally, the ball end of the string may be press fitted into a cup-like, semi-conical or concave retaining apparatus wherein the ball end is securely retained, but may rotate to prevent kinking of the string during restringing and tuning.

In one embodiment, the string exit chamber 23 has individual rollers or ball bearing mechanisms 67 affixed to the inertia block, rotating on pins. The rollers are disposed to allow the string to move on the rollers, eliminating friction points at the inertia block's string exit holes under the base plate and maintaining alignment of the strings within the block. The rollers may also be non-rotating.

The inertia block 1800 contains angled and threaded string chambers of shallow length fender style-side view 1801, medium length fender style-side view 1802 and full length Paul Reed Smith style-side view 1803. Additionally, an angled chambered string exit hole 1804 and angled string exit chamber 1805 are located within the inertia block 1800.

An integrated knurled nut for the swivel and non-swivel ended locking threaded strings 2400 and an integrated knurled nut for the threaded locking screw 2401 are used. A rubber washer, or other shock absorbing/anti-vibration material, is used for the wood screw 157 whereas a steel washer is used for springs and metal flatstock in order to mount onto the "safety claw" 158. The bottom of the inertia "safety block" 159, the entire inertia "safety block" 160 and the entire "safety claw" 161 contain shock absorbing/anti-vibration material. Additionally, screws and nylock nuts are used to fasten the individually mounted hooks to the "safety claw" 163. The "safety claw" assembly contains integrated hooks 164 whereas the "safety claw" contains individually mounted and/or integrated hooks 165. In this embodiment the individually mounted hooks are offset to prevent side to side movement on the "safety claw" 166. There also exists a tremolo spring mounting point for inertia "safety block" attachment 168 and a tremolo spring mounting point for tremolo claw attachment 169. A steel bar may be used to synchronize the two tremolo systems at the same time 2900. This is similarly used on multi-neck guitars containing integrated mounting holes for the steel bar.

In one embodiment, the instant invention may further comprise a steel bar 2900 to preferably synchronize at least two tremolo systems simultaneously. This embodiment may further be utilized with multi-neck guitars. Additionally, the steel bar 2900 further comprises a plurality of integrated mounting holes 2901 and a string hole cavity 2902. Furthermore, in one embodiment the instant invention includes a mounting hole 2903 for a machine screw in an inertia block and off-set chambers 2904 for a tremolo springs/flatstock. Moreover, a threaded machine screw 2905 may be utilized with the steel bar plate 2900.

In yet another embodiment, the instant invention comprises a plurality of threaded machine screw holes 125 on a tremolo claw (i.e. mounting the claw with machine screws). Additionally, a threaded machine hole 126 may be included on a tremolo claw for a ground screw. In one embodiment, the instant invention may include a plurality of "safety claw" steel machine mounting screws 151 for springs and/or a metal flatstock. Additionally, a hanger bolt 152 may be included in this embodiment.

In yet another embodiment, the instant invention further comprises a locking nut 171 for a machine screw, a washing 172 for a machine screw and an acorn nut 173.

In yet another embodiment, a threaded machine screw 192 for a "rail claw system" is disclosed, along with a threaded wood insert 193 for a "rail claw system", or a machine screw for a "rail system" on the claw.

In another embodiment tremolo claw rails 187 are integrated to the tremolo claw. The tremolo claw rails 187 attach to the wall of the tremolo cavity 150, running parallel to the sides of the claw. The tremolo claw rails 187 each further comprise an integrated channel 188 to allow the safety claw to slide within the channels 188. Wood screws are disposed to guide the claw to slide along the tremolo claw rails through an elongated parallel chamber within the tremolo claw rail. The "boxed" claw works in the same fashion the only difference is that there are more threaded holes for optional spring mounting or used as mounting points for aftermarket guitar products. The boxed claw can be 1 or 2 tiers as well. The boxed claw has more metal mass which transmits string vibrations, enhancing tone and sustain throughout the tremolo system, and the musical instrument.

The rail screws are secured to the wall of the tremolo cavity upon reaching a desired tension by the claw screws. The 2 wood screws adjust the tremolo claw spring tension. Once the adjustment is completed, the (2) nylon screws secure these wood screws at the tremolo claw. The system may comprise (2) rail screws. These are comprised of (2) machine inserts for wood applications, and (2) machine screws. These screws secure the sides of the claw to the tremolo cavity. In this case (4) screws are securing the claw to the body. We can also add that (2) wood screws can be utilized instead of the machine screw and machine insert option. In a further embodiment, a shock absorbing/anti-vibration material covers the claw and rail system. An additional embodiment comprises a two tier tremolo claw rail system with optional shock absorbing/anti-vibration material covering the claw and rail system.

Further, the instant system comprises several innovative and technological advances in structure and material usage. Regarding materials, mixing of alloys, natural and/or synthetic material, this device may be manufactured from material such as stainless steel, brass, metal alloy, titanium, carbon fiber or any other suitable natural or synthetic materials not specified herein. Various material compositions alter the tone, sustain, and performance of musical devices. Different alloys and synthetic material have different tones through composition and various alloys. Concurrent bridge/block designs fail to comprise metals added or removed from their systems, other than various replacement bridge saddles. The threaded locking screws, safety claw systems, and inertia block systems allows the user to change the tone by changing the weight and tone by changing the metal composition of the aforementioned components in these devices. The user can alter the weight of the bridge by choosing a smaller locking screws, using alternative metal compositions, or synthetic materials to control the weight, sustain, tonality and composition of the locking inertia block and bridge systems.

Addressing the adjustable metal flatstock/tremolo stabilizers, the instant device can be manufactured from material such as stainless steel, brass, metal alloy, titanium, carbon fiber or any other suitable natural or synthetic materials not specified herein. Various material compositions alter the tone, sustain, and performance of musical devices. This metal device works in conjunction with or without tremolo springs. This innovation will allow for greater sustain, enhanced string vibration and tonal transfer. This will allow the user to have a "hard-tail"/fixed bridge stability on a tremolo guitar without the additional tension from the tremolo springs. Also, you don't have to "block" the tremolo cavity with wood to prevent the inertia block from moving. In addition, all the springs can be removed to eliminate "reverb" and spring noise from the tremolo system. The user may keep a combination of metal flat stock and springs for enhance reverb effect, while the flat stock keeps the tremolo in a Hard Tail/fixed bridge format. The flatstock/tremolo stabilizers may be mounted within the bottom holes designed for the tremolo springs or by the locking spring mechanism screws on the sides of block. The flatstock/tremolo stabilizers are designed to be secured in the locking "safety" Claw.

Further investigating the safety claw, safety claw with "rails" and boxed claw systems, these devices may be manufactured from material such as stainless steel, brass, metal alloy, titanium, carbon fiber or any other suitable natural or synthetic materials not specified herein. Various material compositions alter the tone, sustain, and performance of musical devices. The "safety" claw can be designed with 1 or 2 tiers in standalone configurations, or in conjunction with the "safety claw" with integrated rail system and box style claw systems. The "rail" system and the Box Claw System allow for further tremolo stability and sustain by securing the claw to the sides of the tremolo cavity. The Box Claw System has several more rows of threaded mounting holes for added versatility for spring and flatstock configurations. The "safety" claw has threaded chambers instead of press fit hooks, as in conventional systems.

Natural or synthetic material may be added as an anti-shock/anti-vibration device to eliminate unwanted noises and to enhance performance. This claw can have 1 or 2 tiers and simultaneously include one or multiple rows of threaded holes. The claw can incorporate integrated hooks or individually mounted hooks in conjunction with the threaded holes system. The individually mounted hooks have integrated offset on the bottom of the hooks to prevent side to side movement/rotation while being physically secured by a machine screw and self-locking nut to the safety claw. The locking claws can also have multiple rows for added versatility and adjustability for hooks, or other mountable devices for tremolo systems. The holes can be threaded in different configurations for mounting of springs, flat stock or other aftermarket devices. The shock absorbing/anti-vibration material keeps the springs from rattling or causing sympathetic audible vibrations that can be heard by the guitar's electronics.

The claw is designed to handle positive and negative forces via fastening the springs and flat stock/tremolo stabilizers to the claw. In addition, the locking nylon nut on the wood screw secures the claw in a fixed position so it does not move during the operation of the tremolo. This is a non-altering method for modify vintage or new guitars on the market. The Safety Claw with Rails Systems and the Box Style Systems incorporate a side rails system, with a hollowed out "rail" area that allows the screw to slide back and forth while the tremolo/vibrato and safety claw are being is being calibrated and adjusted. Once the tremolo/vibrato and claw adjustments are completed, then the claw can be locked into place. The rails are secured by (2) specialized wood inserts fastener systems for machine screws which are both located on both sides of the rails. The machine screws along the "rails" are then locked and secured into place. The "safety" system is then locked at four points: The nylon nut lock the (2) wood screws and the (2) machine screws secure the "rail" system. This method improves transmit vibrations, sustain, and tone within tremolo cavity and throughout the guitar. This also keeps the claw in a fixed and stable position. Wood screws can be utilized instead of the machine screws if necessary, or at the discretion of the user.

Exploring the usage of the nylon nut for the wood screw, this nylon nut locks the claw to the wood screws. The wood screw secures the "safety" claw to the guitar body, as well as adjusting and calibrating the tremolo/vibrato system. The nylon prevents the claw from moving on the wood screws, which affords superior coupling of claw, and improved transfer of tone throughout the claw system. This locking nut enhances tremolo/vibrato stability by damping positive and negative forces, as well as stress tensors, which are placed upon the system by the user.

Furthermore, the use of threaded holes, integrated and individually mounted claw hooks for "safety" claw systems—This device can be made out material such as stainless steel, brass, metal alloy, titanium, carbon fiber or any other suitable natural or synthetic materials not specified herein. Various material compositions alter the tone, sustain, and performance of musical devices. This device combines hooks and/or holes in claw design in conjunction with 1 and 2 tier claw designs, as well as, in conjunction with the rails systems and box style "safety" claw designs. This system can incorporate integrated hooks, along with treaded holes or the individually mounted hooks can be manually affixing a claw hook in any location via locking fasteners. The integrated offset designed in the hook prevents side to side motion. The threaded holes utilized locking fasteners to secure the springs and flat stock. This method also allows the safety claw to securely mount the components to the claw systems. The present "press fit" method, which is the standard in the art, does not lock the tremolo springs to the claw, but rather relies on string tension to hold the parts in place. The locking 'safety" claw prevents the user from getting a physical injury from these high tension parts by properly securing these components as an entire unit.

In an additional embodiment, shock absorbing, material/anti-vibration material on the entire locking claw system or bottom portion of block, or combination thereof, the materials utilized prevent the flat stock or springs that are mounted to the locking claw systems from vibrating from metal on metal contact. Said structure prevents the guitars electronics from picking up sympathetic vibrations for extraneous noises from the tremolo/vibrato apparatus within the tremolo cavity. This material can be made out of rubber, foam, or any other natural or synthetic materials or combination thereof. The entire locking claw or select portions of the surface can be modified the anti-vibration material. In addition, all the screws utilized the aforementioned claw systems can utilize anti-vibration material to prevent and/or eliminate sympathetic string vibrations.

Reviewing the inertia block systems, these devices can be constructed from material such as stainless steel, brass, metal alloy, titanium, carbon fiber or any other suitable natural or synthetic materials not specified herein. Various material compositions alter the tone, sustain, and performance of musical devices. Addressing the numerous genres of inertia block systems, there may exist an embodiment comprising fixed string length locking inertia blocks wherein the inertia blocks and string cavity diameters and length vary amongst musical instrument manufacturers and instrument models. The locking inertia blocks and locking string chambers will be manufactured in accordance within dimension set forth by the manufacture's designs and dimensions. These string chambers/cavities can range from shallow chambered string cavities to fully chambered cavities along the same horizontal plane. In this format, the threaded chambers are of equal length, even though some guitar makers make various length chambers within the tremolo block. The locking block system incorporates a threaded chamber system that uses a locking bolt mechanism to securely lock the ball end of the musical string in place. The locking bolt mechanism may lock the string from the bottom or side of the inertia block.

In a further embodiment of inertia block systems, there may exist fixed compensated locking inertia blocks which comprise threaded chambers permanently alter the string length of each individual chamber. The length of the chamber would be calibrated to the guitar type and scale length system. In this format, the string length is permanently compensated. These are non-adjustable fixed position chambers. These blocks compensate for string to string tuning when the tremolo is being used.

Additional embodiments may include adjustable, fully compensated locking blocks—similar to the above. These are fully chambered blocks with metal inserts/string length adjusters to compensate for string to string tuning. A hex head wrench is used to adjust the metal inserts. These blocks are also designed with locking mechanism to secure/lock the string length adjusters to the desired tuning/string length. The lengths of the compensated chambers within the inertia block are dependent on their mathematical placement for tuning optimizations with scale length and correlation with adjacent strings. The user, with proper musical equipment can alter the performance of the tremolo/vibrato system with the internal string length adjusters.

Further novel systems include adjustable threaded adjusters/inserts with locking mechanisms, which may be used to adjust string length inside a fully adjustable compensating block. The string length adjusters can be locked in place by the external locking screws system that is designed/incorporated along the exterior portion of string chamber on the outside portion of the block. The string end goes inside the insert, and the insert is adjusted via hex wrench.

In an additional embodiment, there may be a system comprising threaded locking chambers wherein the inertia blocks and string cavity diameters and length vary amongst musical instrument manufacturers and instrument models. The locking inertia blocks and locking string chambers will be manufactured in accordance within dimension set forth by the manufacture's designs and dimensions. The threaded locking chambers can be designed to be accessed from the bottom and/or side of the inertia block, depending upon the length, diameter and dimensions of the threaded cavities. Depending upon the design and thickness of the inertia block, the threaded chambers will be either made in a vertical threaded design or an angled threaded design.

The vertical threaded chambers may be located in a vertical orientation within the inertia block. The threaded locking bolt/mechanism vertically enters of the inertia block and it is screwed in to achieve either a physically locking or spatially locking of the ball end of the musical string. Angled threaded chambers specially designed threaded chambers/string cavities designed to a specified degree within inertia block. The threaded locking bolt/mechanism enters the specified degree/angled threaded chamber and it is screwed in to achieve either a physically locking or spatially locking of the ball end of the musical string.

Additionally, the system may comprise an embodiment comprising horizontal threaded chambers and these threaded locking string chambers/cavities are located on the back of inertia block. The locking chambers can be designed to accommodate physically locking the string at the ball end, or spatially lock the string through the center of the ball ended string. The diameter of the horizontal threaded chambers can vary dependent upon the physically locking or spatially locking designs.

In another embodiment locking string mechanisms/bolts may be utilized where the bolts secure a ball end of a string from multiple angles. The locking mechanism can be entered from the bottom and/or side of the inertia block. And, a locking mechanism for tremolo springs and adjustable flatstock devices may exist wherein the locking inertia block incorporates a locking mechanism that secures the end of the tremolo spring to the inertia block via set screws. Up to 5 tremolo springs can be secured to the inertia block. The adjustable flatstock devices can be mounted within the tremolo spring cavity within the inertia block or mounted to this locking mechanism. This device prevents the tremolo springs or adjustable flatstock devices from vibrating free or being accidently removed from the inertia block.

Moreover, investigating the genres of locking disclosed herein, the mechanism for physically locking the ball end of the string from the bottom or side of the inertia block, as illustrated, requires physical contact between the locking mechanism and the string end. Physically locking a string end can be achieved by securing a locking mechanism which crates physical contact against the bottom or side of a ball end or string loop of a musical string. Additionally, spatially locking the ball end of the string from the bottom has been disclosed, which features a dearth of physical contact between the locking mechanism and the string end. This locking design concept is to limit the amount of space between the string and the locking mechanism, without any actual physical contact with the musical string end. It is possible to achieve locking results by severely restricting string movement between the locking device and the string. The side locking mechanism can be small enough to enter the small diameter hole within the ball ended string. Since the string is being locked in the center of the ball end or string loop, it would be considered spatially locked because there is no physical contact between the locking mechanism and the string. There would be a negligible amount movement of between the musical string and the locking device.

In further embodiments, shock absorbing, material/anti-vibration material may be utilized on the entire block or bottom portion of block, or any combination thereof, and this arrangement may be utilized to prevent the flat stock or springs that are mounted to the inertia block from vibrating from metal on metal contact. This prevents the guitar's electronic systems from picking up sympathetic vibrations for extraneous noises from the tremolo/vibrato apparatus within the tremolo cavity. This material may be manufactured from rubber, foam, or any other natural or synthetic materials or combination thereof. The entire block or select portions of the inertia block can be modified the anti-vibration material.

And, the system may contain another form of stabilization mechanism wherein the tremolo spring and flat stock/tremolo stabilizers are kept in line via locking screws to vitiate movement of the inertia block. This also provides a fixed "locked" design for optimum transfer of vibrations from the strings, bridge plate, inertia block and tremolo claw system. This is an enhancement from modern day designs in the art.

Also disclose are adjustable metal inserts locking mechanism on the outside portion of the block, wherein screws may be utilized to lock the metal inserts in place so they do not move when restringing. Additionally, a tremolo arm tension screw may be utilized within on the system. Moreover the tremolo plate may comprise oversized "oval" shaped holes on base plate in order that the string will not rub against the tremolo/vibrato bridge plate which thus eliminates a friction point between the string at the bridge saddle and the inertia block.

Finally, a series of child safe designs may be incorporated into the inventions and the first may comprise a safety inertia block which locks the tremolo springs and flat stock to the inertia block via machine screws. These high tension steel parts are secured, therefore, virtually eliminating serious physical injury. The ends of the strings are locked into position within the inertia block, therefore, no small string ends will be accessible to children. Adult supervision will be required to make adjustments to the tremolo/vibrato system and restringing the musical instrument. Moreover, the string sharp ends that are forcefully ejected from the musical instrument may cause serious bodily injuries such as a puncture wound or choking hazard for the user or bystanders.

This feature allows parents, or guardians to remove strings or oversee the removal the musical strings when they become defective. The broken string recoil affords for the musical strings are stretched to tension by the tuning machines. The musical string in under tremendous force and that force is released when a string fails and breaks while the musical instrument is being played. The locking mechanism within the inertia block secures the string within the confines of said device. The locking feature virtually eliminates the string from the "Broken stretched rubber band effect" which causes the string to forcefully exit the guitar, causing possible injury to the user. The locking feature of the locking inertia block absorbs the force of the broken string, therefore, reducing personal injury.

Moreover, the locking claw system, the locking claw system secures the tremolo springs and flatstock/tremolo stabilizers to the claw via a fastener system. The machine screws and locking nuts properly secure these items to the locking claw. The tremolo springs and flatstock/tremolo stabilizers are under high tension, which may cause injury to the user. The locking claw system requires mechanical tools to remove the tremolo springs and flatstock devices. The locking claw virtually eliminates physical injuries when modifying or adjusting these devices. A modified nylon nut may be used to secure the wood screw that secures the claw to the tremolo cavity.

Finally, the system may comprise a dual vibrato/tremolo systems for multi-neck musical instruments, designed to join two separate inertia blocks together as one unit. A steel bar is secured by machine screws at multiple points along the bottom of the inertia block. When the tremolo bar is raised or depressed, both bridges will move simultaneously, thus providing the tremolo/vibrato effect on both instruments.

In conclusion, herein is presented a stringed instrument system. The invention is illustrated by example in the drawing figures, and throughout the written description. It should be understood that numerous variations are possible, while adhering to the inventive concept. Such variations are contemplated as being a part of the present invention.

What is claimed is:

1. A claw mechanism for a stringed instrument comprising:

a rail system comprising a set of side rails comprising a hollowed out rail area comprising a slidably attached screw mechanism for tremolo and claw calibrate and adjustment; wherein the rail system comprises a configuration selected from a group consisting of single tier, and double tier;

at least one row of threading mounting apertures;

a set of individually mounted hooks on a lower portion of the hooks to prevent side to side movement and a combination machine screw and self-locking nut mechanism for fastening to the claw mechanism for a stringed instrument;

a set of fastening mechanisms disposed to secure the claw in a fixed position wherein the set of fastening mechanisms are selected from the group consisting of nylon screws, wood screws, nylon nuts, metal nuts; and a set of at least three compression springs in communication with the set of fastening mechanisms.

2. The claw mechanism for a stringed instrument of claim 1 wherein the claw mechanism further comprises at least one row of threaded holes for mounting a set of accessories selected from the group consisting of springs and flat stock.

3. The claw mechanism for a stringed instrument of claim 1 wherein the rails are secured by a rail claw system comprising a threaded machine screw along with a threaded wood insert located on each rail.

4. The claw mechanism for a stringed instrument of claim 3 wherein the machine screws along the rails are locked in place and comprise a safety system locked at four points.

5. The claw mechanism for a stringed instrument of claim 1 further comprising a set of integrated channels on each rail of the claim mechanism.

6. The claw mechanism for a stringed instrument of claim 5 wherein the set of integrated channels further comprise a set of bushings such that the set of bushings slide within the set of integrated channels attached to the rails.

7. The claw mechanism for a stringed instrument of claim 2 wherein the claw mechanism for a stringed instrument is secured to the tremolo springs and flat stock stabilizers via a fastener system and the fastener system further comprising a set of shock absorbers comprising anti-vibratory material wherein the shock absorbers are located against the flat stock in order to prevent the flat stock and springs from vibrating due to metal on metal contact.

8. The claw mechanism for a stringed instrument of claim 1 wherein the claw mechanism is utilized with stringed instrument systems selected from the group consisting of: acoustic bridge designs, stop tailpieces, trapeze style tailpieces, locking string designs, fused round/bearing ended string, and style bridges.

* * * * *